US010370922B2

(12) United States Patent
Hradecky

(10) Patent No.: US 10,370,922 B2
(45) Date of Patent: Aug. 6, 2019

(54) DOWNHOLE-ADJUSTING IMPACT APPARATUS AND METHODS

(71) Applicant: Impact Selector International, LLC, Houma, LA (US)

(72) Inventor: Jason Allen Hradecky, Heath, TX (US)

(73) Assignee: Impact Selector International, LLC, Houma, LA (US)

( * ) Notice: Subject to any disclaimer, the term of this patent is extended or adjusted under 35 U.S.C. 154(b) by 232 days.

(21) Appl. No.: 15/492,237

(22) Filed: Apr. 20, 2017

(65) Prior Publication Data

US 2017/0218714 A1 Aug. 3, 2017

Related U.S. Application Data

(63) Continuation of application No. 14/316,767, filed on Jun. 26, 2014, now Pat. No. 9,631,445.
(Continued)

(51) Int. Cl.
*E21B 31/107* (2006.01)
*E21B 47/12* (2012.01)
*E21B 17/00* (2006.01)

(52) U.S. Cl.
CPC ..... *E21B 31/107* (2013.01); *E21B 17/003* (2013.01); *E21B 47/12* (2013.01)

(58) Field of Classification Search
CPC ..... E21B 31/00; E21B 31/107; E21B 31/113; E21B 31/1135
(Continued)

(56) References Cited

U.S. PATENT DOCUMENTS 1,954,513 A 4/1934 Beck
2,144,869 A 1/1939 Boulter
(Continued)

FOREIGN PATENT DOCUMENTS

CN 200940461 Y 8/2007
CN 201173100 Y 12/2008
(Continued)

OTHER PUBLICATIONS

PCT/US2014/044470 International Search Report and Written Opinion dated Dec. 16, 2014, 13 pages.

*Primary Examiner* — Brad Harcourt
*Assistant Examiner* — David Carroll
(74) *Attorney, Agent, or Firm* — Boisbrun Hofman, PLLC

(57) ABSTRACT

A downhole-adjusting impact apparatus (DAIA) mechanically coupled between opposing first and second portions of a tool string, wherein: the tool string is conveyable within a wellbore extending between a wellsite surface and a subterranean formation; the first tool string portion comprises a first electrical conductor in electrical communication with surface equipment disposed at the wellsite surface; the DAIA comprises a second electrical conductor in electrical communication with the first electrical conductor; and the DAIA is operable to: detect an electrical characteristic of the second electrical conductor; impart a first impact force on the second tool string portion when the electrical characteristic is detected; and impart a second impact force on the second tool string portion when the electrical characteristic is not detected, wherein the second impact force is substantially greater than the first impact force.

18 Claims, 13 Drawing Sheets

Related U.S. Application Data

(60) Provisional application No. 61/839,455, filed on Jun. 26, 2013.

(58) Field of Classification Search
USPC ..... 166/178; 173/117, 217
See application file for complete search history.

(56) References Cited

U.S. PATENT DOCUMENTS 2,166,299 A 7/1939 Kennedy et al.
2,557,238 A 6/1951 Shaffer
2,634,102 A 4/1953 Howard
2,903,241 A 9/1959 Brown
3,208,541 A 9/1965 Lawrence
3,360,060 A 12/1967 Kinley et al.
3,685,598 A 8/1972 Nutter
4,333,542 A 6/1982 Taylor
4,463,815 A 8/1984 Jurgens et al.
4,607,692 A 8/1986 Zwart
4,665,998 A 5/1987 Burton
4,919,219 A 4/1990 Taylor
5,022,473 A 6/1991 Taylor
5,052,485 A 10/1991 Reid
5,103,903 A 4/1992 Marks, II
5,139,086 A 8/1992 Griffith, Sr.
5,156,211 A 10/1992 Wyatt
5,170,843 A 12/1992 Taylor
5,228,507 A 7/1993 Obrejanu et al.
5,267,613 A 12/1993 Zwart et al.
5,330,018 A 9/1994 Griffith
5,398,753 A 3/1995 Obrejanu et al.
5,595,244 A 1/1997 Roberts
5,844,157 A 12/1998 Kasha
5,875,842 A 3/1999 Wyatt
5,931,242 A 8/1999 Oettli
6,032,733 A 3/2000 Ludwig et al.
6,176,325 B1 1/2001 Rodger
6,290,004 B1 9/2001 Evans
6,481,495 B1 11/2002 Evans
6,640,899 B2 11/2003 Day et al.
6,655,460 B2 12/2003 Bailey et al.
6,725,932 B2 4/2004 Taylor et al.
6,843,317 B2 1/2005 Mackenzie
6,896,060 B2 9/2005 Marsh
6,948,560 B2 9/2005 Marsh
6,988,551 B2 1/2006 Evans
7,025,130 B2 4/2006 Bailey et al.
7,111,678 B2 9/2006 McElroy et al.
7,264,055 B2 9/2007 Mody et al.
7,267,176 B2 9/2007 Madden
7,281,575 B2 10/2007 McElroy et al.
7,293,614 B2 11/2007 Rose
7,311,149 B2 12/2007 Evans
7,367,397 B2 5/2008 Clemens et al.
7,395,862 B2 7/2008 Ross et al.
7,510,008 B2 3/2009 Evans
7,533,724 B2 5/2009 McLaughlin
7,607,478 B2 10/2009 Martinez et al.
7,775,280 B2 8/2010 Rose
7,854,425 B2 12/2010 Evans
7,874,364 B2 1/2011 Redlinger et al.
8,025,105 B2 9/2011 Templeton et al.
8,074,716 B2 12/2011 Melder et al.
8,151,910 B2 4/2012 Swinford
8,186,212 B2 5/2012 Romero et al.
8,191,626 B2 6/2012 Hradecky
8,220,541 B2 7/2012 Martinez et al.
8,225,860 B2 7/2012 Hradecky
8,256,509 B2 9/2012 Evans
8,286,717 B2 10/2012 Giroux et al.
8,322,413 B2 12/2012 Bishop et al.
8,360,109 B2 1/2013 Johnson
8,365,818 B2 2/2013 Schultz et al.
8,366,082 B2 2/2013 Evans
8,418,758 B2 4/2013 Hradecky
8,443,902 B2 5/2013 Evans
8,474,542 B2 7/2013 Blanton et al.
8,499,836 B2 8/2013 Moriarty et al.
8,550,155 B2 10/2013 Schultz et al.
8,561,687 B2 10/2013 Moore et al.
8,561,688 B2 10/2013 Evans
8,567,515 B2 10/2013 Giroux et al.
8,657,007 B1 2/2014 Watson et al.
8,695,696 B2 4/2014 Shoyhetman et al.
8,770,278 B2 7/2014 Lauderdale
8,783,343 B2 7/2014 Giroux et al.
8,789,598 B1 7/2014 Micak et al.
8,813,876 B2 8/2014 Sallwasser et al.
8,869,885 B2 10/2014 O'Malley
8,893,779 B2 11/2014 Tradaway et al.
2001/0018974 A1 9/2001 Mouton et al.
2002/0112866 A1 8/2002 Buyers et al.
2003/0070842 A1* 4/2003 Bailey ..... E21B 7/06 175/24
2009/0095490 A1* 4/2009 Moriarty ..... E21B 31/107 166/383
2009/0266544 A1 10/2009 Redlinger et al.
2011/0297380 A1 12/2011 Alberty et al.
2012/0090843 A1 4/2012 Vagapov et al.
2012/0279724 A1 11/2012 Eddison et al.
2013/0068533 A1 3/2013 Hradecky et al.
2013/0168092 A1 7/2013 Evans
2013/0227057 A1 10/2013 Evans
2013/0277057 A1 10/2013 Evans
2014/0131100 A1 5/2014 Hradecky
2014/0196911 A1 7/2014 Hradecky
2015/0000892 A1 1/2015 Hradecky

FOREIGN PATENT DOCUMENTS

GB 2340154 A 2/2000
WO 0116460 A2 3/2001
WO 2014120873 A1 8/2014

* cited by examiner

DOWNHOLE-ADJUSTING IMPACT APPARATUS AND METHODS

CROSS-REFERENCE TO RELATED APPLICATIONS

This application is a continuation U.S. patent application Ser. No. 14/316,767, titled "Downhole-Adjusting Impact Apparatus and Methods," filed Jun. 26, 2014, which claimed priority to and the benefit of U.S. Provisional Application No. 61/839,455, entitled "Smart Jar," filed Jun. 26, 2013, the entire disclosures of each being hereby incorporated herein by reference.

BACKGROUND OF THE DISCLOSURE

Drilling operations have become increasingly expensive as the need to drill deeper, in harsher environments, and through more difficult materials have become reality. Additionally, testing and evaluation of completed and partially finished well bores has become commonplace, such as to increase well production and return on investment.

In working with deeper and more complex wellbores, it becomes more likely that tools, tool strings, and/or other downhole apparatus may become stuck within the bore. In addition to the potential to damage equipment in trying to retrieve it, the construction and/or operation of the well must generally stop while tools are fished from the bore. The fishing operations themselves may also damage the wellbore and/or the downhole apparatus.

Furthermore, downhole tools are regularly subjected to high temperatures, temperature changes, high pressures, and the other rigors of the downhole environment. Consequently, internal components of the downhole tools may be subjected to repeated stresses that may compromise reliability.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
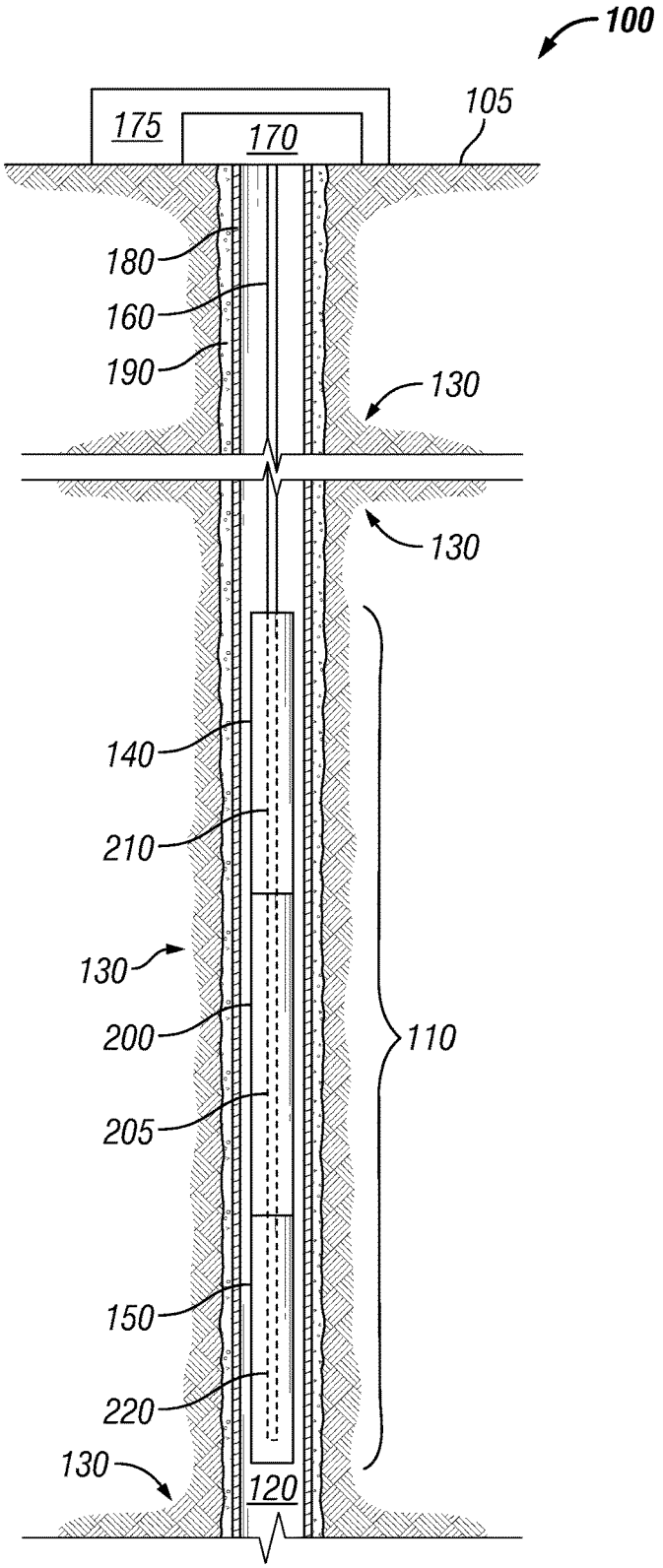
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a sectional view of at least a portion of an implementation of a wellsite system 100 according to one or more aspects of the present disclosure. The wellsite system 100 comprises a tool string 110 suspended within a wellbore 120 that extends from a wellsite surface 105 into one or more subterranean formations 130. The tool string 110 comprises a first portion 140, a second portion 150, and a downhole-adjusting impact apparatus (DAIA) 200 coupled between the first portion 140 and the second portion 150.

The tool string 110 is suspended within the wellbore 120 via conveyance means 160 operably coupled with a tensioning device 170 and/or other surface equipment 175 disposed at surface 105.

The wellbore 120 is depicted in FIG. 1 as being a cased-hole implementation comprising a casing 180 secured by cement 190. However, one or more aspects of the present disclosure are also applicable to and/or readily adaptable for utilizing in open-hole implementations lacking the casing 180 and cement 190.

The tensioning device 170 is operable to apply an adjustable tensile force to the tool string 110 via the conveyance means 160. Although depicted schematically in FIG. 1, a person having ordinary skill in the art will recognize the tensioning device 140 as being, comprising, or forming at least a portion of a crane, winch, drawworks, top drive, and/or other lifting device coupled to the tool string 110 by the conveyance means 160. The conveyance means 160 is or comprises wireline, slickline, e-line, coiled tubing, drill pipe, production tubing, and/or other conveyance means, and comprises and/or is operable in conjunction with means for communication between the tool string 110 and the tensioning device 170 and/or one or more other portions of the various surface equipment 175.

The first and second portions 140 and 150 of the tool string 110 may each be or comprise one or more downhole tools, modules, and/or other apparatus operable in wireline, while-drilling, coiled tubing, completion, production, and/or other implementations. The first portion 140 of the tool string 110 also comprises at least one electrical conductor 210 in electrical communication with at least one component of the surface equipment 175, and the second portion 150 of the tool string 110 also comprises at least one electrical conductor 220 in electrical communication with at least one component of the surface equipment 175, wherein the at least one electrical conductor 210 of the first portion 140 of the tool string 110 and the at least one electrical conductor 220 of the second portion 150 of the tool string 110 may be in electrical communication via at least one or more electrical conductors 205 of the DAIA 200. Thus, the one or more electrical conductors 205, 210, 220, and/or others may collectively extend from the conveyance means 160 and/or the first tool string portion 140, into the DAIA 200, and perhaps into the second tool string portion 150, and may include various electrical connectors along such path.

The DAIA 200 may be employed to retrieve a portion of the tool string 110 that has become lodged or stuck within the wellbore 120, such as the second portion 150. The DAIA 200 may be coupled to the second portion 150 of the tool string 110 before the tool string 110 is conveyed into the well-bore, such as in prophylactic applications, or after at least a portion of the tool string 110 (e.g., the second portion 150) has become lodged or stuck in the wellbore 120, such as in "fishing" applications.

Figure 2:
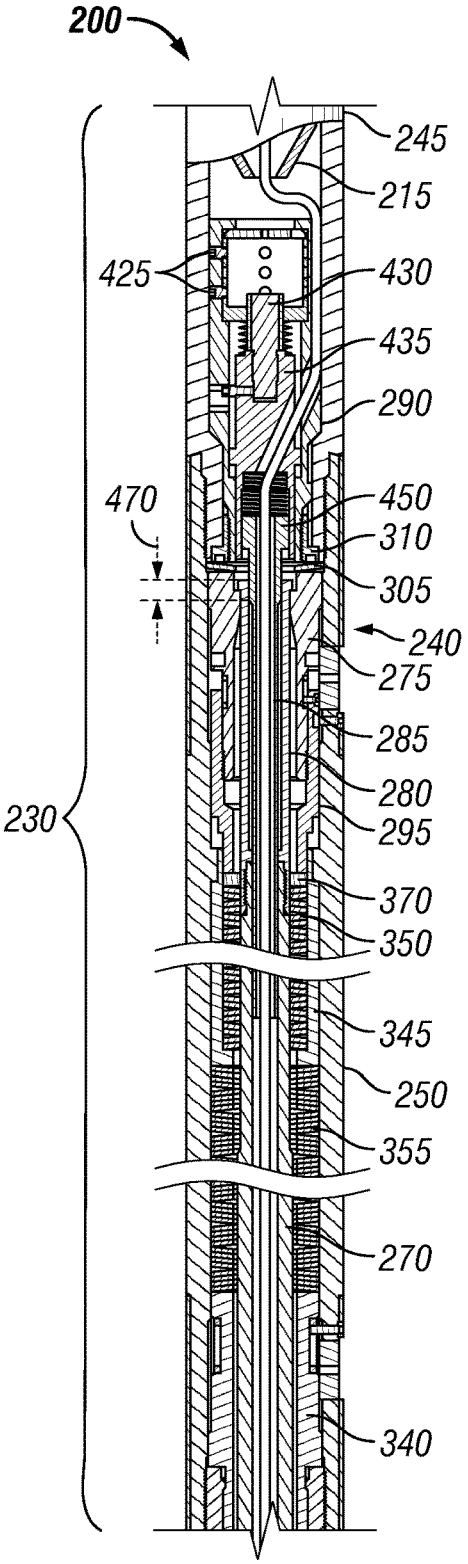
FIG. 2 is a sectional view of an example implementation of a portion of the apparatus shown in FIG. 1 according to one or more aspects of the present disclosure.
Figure 3:
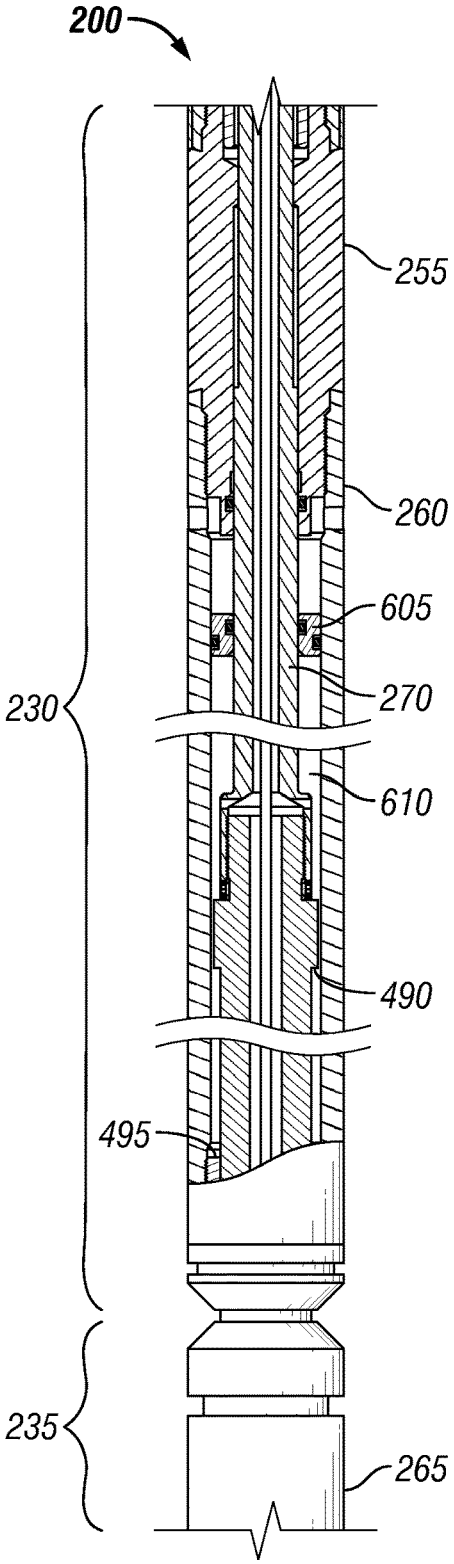
FIG. 3 is a sectional view of another portion of the example implementation shown in FIG. 2 according to one or more aspects of the present disclosure.

FIG. 2 is a sectional view of an uphole (hereafter "upper") portion of an example implementation of the DAIA 200 shown in FIG. 1. FIG. 3 is a sectional view of a downhole (hereafter "lower") portion of the example implementation of the DAIA 200 shown in FIG. 2. Referring to FIGS. 1-3, collectively, the DAIA 200 comprises an electrical conductor 205 in electrical communication with the electrical conductor 210 of the first portion 140 of the tool string 110.

For example, one or more electrical connectors and/or other electrically conductive members 215 may at least partially connect or extend between the electrical conductor 205 of the DAIA 200 and the electrical conductor 210 of the first portion 140 of the tool string 110. The electrical conductor 205 may also be in electrical communication with an electrical conductor 220 of the second portion 150 of the tool string 110. For example, one or more electrical connectors and/or other electrically conductive members (not explicitly shown) may extend between the electrical conductor 205 of the DAIA 200 and the electrical conductor 220 of the second portion 150 of the tool string 110. Thus, the electrical conductor 210 of the first portion 140 of the tool string 110 may be in electrical communication with the electrical conductor 220 of the second portion 150 of the tool string 110 via the electrical conductor 205 of the DAIA 200 and, perhaps, one or more additional electrically conductive members 215. Furthermore, the electrical conductor 210 of the first portion 140 of the tool string 110, the electrical conductor 205 of the DAIA 200, and the electrical conductor 220 of the second portion 150 of the tool string 110, and perhaps one or more additional electrically conductive members 215, may be in electrical communication with the surface equipment 175, such as via the conveyance means 160.

The DAIA 200 and/or associated apparatus is operable to detect an electrical characteristic of the electrical conductor 205, impart a first impact force on the second portion 150 of the tool string 110 when the electrical characteristic is detected, and impart a second impact force on the second portion 150 of the tool string 110 when the electrical characteristic is not detected. The second impact force is substantially greater than or otherwise different from the first impact force. For example, the first impact force may be about 3,500 pounds (or about 15.6 kilonewtons), whereas the second impact force may be about 9,000 pounds (or about 40.0 kilonewtons). However, other quantities are also within the scope of the present disclosure. For example, the first impact force may range between about 1,000 pounds (or about 4.4 kilonewtons) and about 6,000 pounds (or about 26.7 kilonewtons), and the second impact force may range between about 6,000 pounds (or about 26.7 kilonewtons) and about 12,000 pounds (or about 53.4 kilonewtons). A difference between the first and second impact forces may range between about 1,000 pounds (or about 4.4 kilonewtons) and about 6,000 pounds (or about 26.7 kilonewtons), although other differences are also within the scope of the present disclosure. The impact forces may be substantially equal to the tensile forces applied to the tool string 110 at the time the DAIA 200 is triggered, as described below.

The electrical characteristic detected by the DAIA 200 may be a substantially non-zero voltage and/or current, such as in implementations in which the electrical characteristic is a voltage substantially greater than about 0.01 volts and/or a current substantially greater than about 0.001 amperes. For example, the electrical characteristic may be a voltage substantially greater than about 0.1 volts and/or a current substantially greater than about 0.01 amperes. However, other values are also within the scope of the present disclosure.

As at least partially shown in FIGS. 2 and 3, the DAIA 200 comprises an upper DAIA section 230 coupled to the first portion 140 of the tool string 110, a lower DAIA section 235 coupled to the second portion 150 of the tool string 110, and a latching mechanism 240. The upper DAIA section 230 comprises an upper sub 245 coupled to the first portion 140 of the tool string 110, an upper housing 250 coupled to the upper sub 245, a connector 255 coupled to the upper housing 250 opposite the upper sub 245, and a lower housing 260 coupled to the connector 255 opposite the upper housing 250. The lower DAIA section 235 comprises a lower sub 265 coupled to the second portion 150 of the tool string 110, and a shaft 270 extending between the lower sub 265 and the latching mechanism 240. The shaft 270 extends into the lower housing 260, the connector 255, and the upper housing 250. The upper and lower DAIA subs 245 and 265 may be coupled to the first and second tool string portions 140 and 150, respectively, via threaded engagement, one or more fasteners, box-pin couplings, other oil field component field joints and/or coupling means, and/or otherwise.

The latching mechanism 240 comprises a female latch portion 275, a male latch portion 280, and an anti-release member 285. The female latch portion 275 is slidably retained within the upper first housing 250 between a detector housing 290 and at least a portion of an upper adjuster 295. A floating separator 305 may be disposed between the female latch portion 275 and the detector housing 290. In the depicted implementation, the separator 305 is a Belleville washer sandwiched between the female latch portion 275 and a lock ring 310. The lock ring 310 may be threadedly engaged with the detector housing 290 to retain mating engagement between corresponding conical or otherwise tapered mating surfaces 315 external to the detector housing 290 with corresponding conical or otherwise tapered mating surfaces 317 internal to the upper sub 245, thus positionally fixing the detector housing 290 relative to the upper sub 245.

Figure 22:
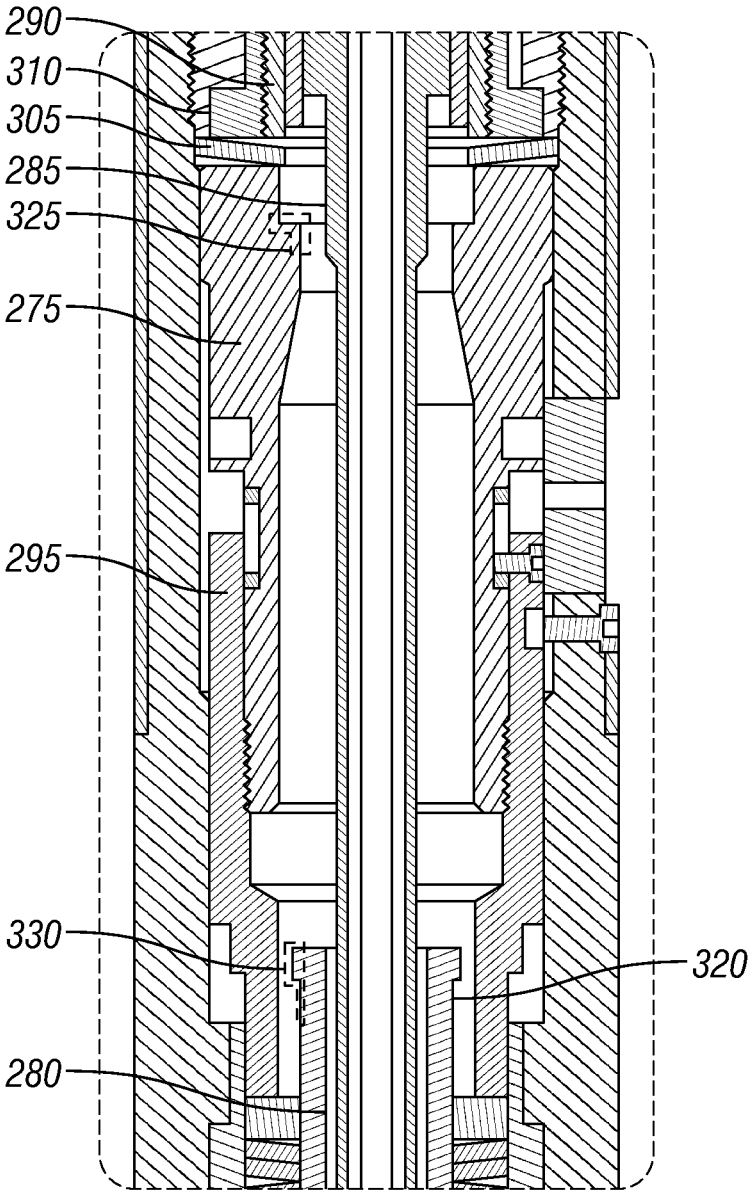
FIG. 22 is an enlarged sectional view of a portion of the apparatus shown in FIG. 6 according to one or more aspects of the present disclosure.

The male latch portion 280 comprises a plurality of flexible members 320 collectively operable to detachably engage the female latch portion 275. While only two instances are visible in the figures, a person having ordinary skill in the art will readily recognize that more than two instances of the flexible member 320 collectively encircle the anti-release member 285. The male latch portion 280 is coupled to or otherwise carried with the shaft 270, such as via threaded means, fasteners, pins, press/interference fit, and/or other coupling 272. Thus, the female latch portion 275 is carried with and/or by the upper portion DAIA section 230 and, thus, the first or upper portion 140 of the tool string 110, whereas the male latch portion 280 is carried with and/or by the lower DAIA section 235 and, thus, the second or lower portion 150 of the tool string 110. The detachable engagement between the female and male latch portions 275 and 280, respectively, is between an internal profile 325 of the female latch portion 275 and an external profile 330 of each of the plurality of flexible members 320, as more clearly depicted in FIG. 22, which is an enlarged portion of FIG. 6 that depicts an operational stage in which the female and male latch portions 275 and 280, respectively, have disengaged.

Figure 12:
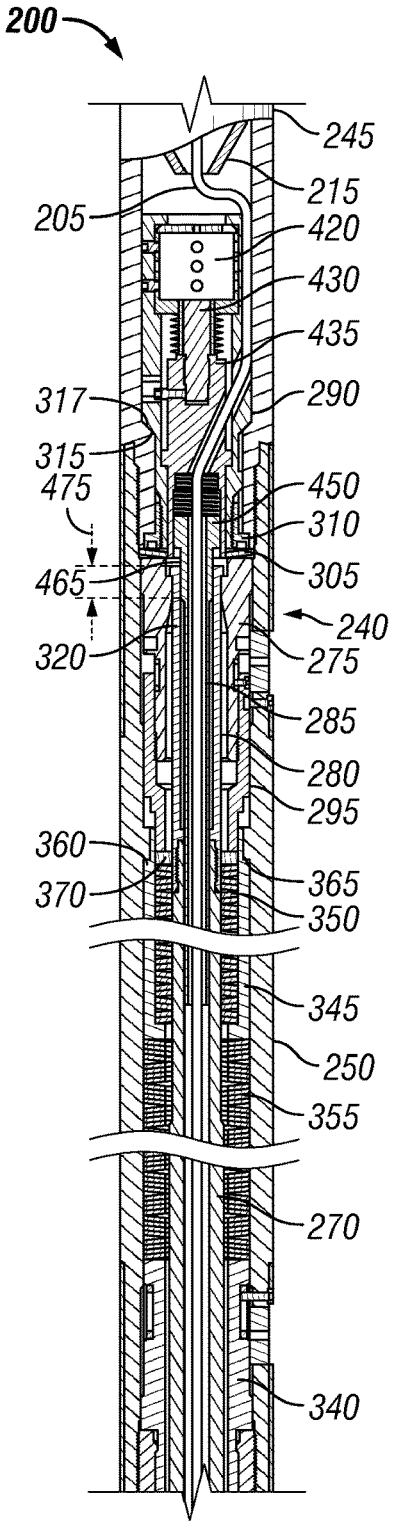
FIG. 12 is a sectional view of another example implementation of a portion of the apparatus shown in FIG. 1 according to one or more aspects of the present disclosure.

The anti-release member 285 is moveable within the male latch portion 280 between a first position, shown in FIG. 2 and corresponding to when the DAIA 200 detects the electrical characteristic on the electrical conductor 205, and a second position, shown in FIG. 12 and corresponding to when the DAIA 200 does not detect (or detects the absence of) the electrical characteristic on the electrical conductor 205. The anti-release member 285 prevents radially inward deflection of the plurality of flexible members 320, and thus disengagement of the female and male latch portions 275 and 280, respectively, when the tensile force applied across the latching mechanism 240 is substantially less than the first impact force when the anti-release member 285 is in the first position shown in FIG. 2, and substantially less than the second impact force when the anti-release member 285 is in the second position shown in FIG. 12. Such operation is described in greater detail below.

The upper adjuster 295 is threadedly engaged with the female latch portion 275, such that the upper adjuster 295 and the female latch portion 275 float axially between, for example, the lock ring 310 and an internal shoulder 335 of the upper housing 250, and such that rotation of the female latch portion 275 relative to the upper adjuster 295 adjusts the relative axial positions of the female latch portion 275 and the upper adjuster 295. The DAIA 200 also comprises a lower adjuster 340 disposed within the upper housing 250 and threadedly engaged with the connector 255, such that the axial position of the lower adjuster 340 is adjustable in response to rotation of the lower adjuster 340 relative to the connector 255 and/or the upper housing 250. The DAIA 200 also comprises a carrier 345 slidably retained within the upper housing 250, an upper spring stack 350 slidably disposed within the annulus defined within the carrier 345 by the shaft 270 and/or the male latch portion 280, and a lower spring stack 355 slidably retained between the carrier 345 and the lower adjuster 340. The upper and lower spring stacks 350 and 355, respectively, may each comprise one or more Belleville washers, wave springs, compression springs, and/or other biasing members operable to resist contraction in an axial direction.

The lower spring stack 355 biases the carrier 345 away from the lower adjuster 340 in an uphole direction, ultimately urging an uphole-facing shoulder 360 of the carrier 345 towards contact with a corresponding, downhole-facing, interior shoulder 365 of the upper housing 250. The upper spring stack 350 biases the upper adjuster 295 away from the carrier 345 (perhaps via one or more contact ring, washers, and/or other annular members 370), thus urging the interior profile 325 of the female latching portion 275 into contact with the exterior profile 330 of the plurality of flexible members 320, when the anti-release member 285 is positioned within the ends of the flexible members 320. The upper spring stack 350 also urges the female latching portion 275 (via the adjuster 295) towards contact with the separator 305, when permitted by engagement between the female and male latch portions 275 and 280, respectively.

Thus, as explained in greater detail below: (1) the lower adjuster 340 is disposed in the upper housing 250 at an axial location that is adjustable relative to the upper housing 250 in response to rotation of the lower adjuster 340 relative to the upper housing 250, (2) the upper spring stack 350 is operable to resist relative movement (and thus disengagement) of the female and male latch portions 275 and 280, respectively, and (3) the lower spring stack 355 is also operable to resist relative movement (and thus disengagement) of the female and male latch portions 275 and 280, respectively, wherein: (A) the female latch portion 275 is axially fixed relative to the upper housing 250, (B) the male latch portion 280 is axially fixed relative to the upper housing 250, (C) the difference between a first magnitude of the first impact force and a second magnitude of the second impact force is adjustable via adjustment of the relative locations of the female latch portion 275 and the upper adjuster 295 in response to relative rotation of the female latch portion 275 and the upper adjuster 295, (D) the second magnitude of the second impact force is adjustable in response to adjustment of the location of the lower, "static" end of the lower spring stack 355 relative to the upper housing 250, which is accomplished by adjusting the location of the lower adjuster 340 via rotation relative to the upper housing 250 and/or connector 255.

Rotation of the female latch portion 275 relative to the upper housing 250 may be via external access through an upper window 375 extending through a sidewall of the upper housing 250. The upper window 375 may be closed during operations via one or more of: a removable member 380 sized for receipt within the window 375; and a rotatable cover 385 having an opening (not numbered) that reveals the window 375 when rotationally aligned to do so but that is also rotatable away from the window 375 such that the cover 385 obstructs access to the window 375. A fastener 390 may prevent rotation of the cover 385 during operations.

Rotation of the lower adjuster 340 relative to the upper housing 250 may be via external access through a lower window 395 extending through a sidewall of the upper housing 250. The lower window 395 may be closed during operations via one or more of: a removable member 405 sized for receipt within the window 395; and a rotatable cover 410 having an opening (not numbered) that reveals the window 395 when rotationally aligned to do so but that is also rotatable away from the window 395 such that the cover 410 obstructs access to the window 395. A fastener 415 may prevent rotation of the cover 410 during operations.

The detector housing 290 contains, for example, a detector 420 operable to detect the electrical characteristic based upon which the higher or lower impact force is imparted by the DAIA 200 to the lower tool string portion 150. For example, as described above, the detector 420 may be operable to detect the presence of current and/or voltage on the electrical conductor 205, such as in implementations in which the detector is and/or comprises a transformer, a Hall effect sensor, a Faraday sensor, a magnetometer, and/or other devices operable in the detection of current and/or voltage. The detector 420 may be secured within the detector housing 290 by one or more threaded fasteners, pins, and/or other means 425.

The detector 420 also is, comprises, and/or operates in conjunction with a solenoid, transducer, and/or other type of actuator operable to move the anti-release member 285 between the first position (shown in FIG. 2) and the second position (shown in FIG. 12) based on whether the electrical characteristic sensor of the detector 420 detects the electrical characteristic. In the example implementation depicted in FIG. 2, such actuator comprises a plunger 430 extending from the detector 420 and coupled to a mandrel 435 that slides axially with the plunger 430 inside the detector housing 290. The plunger 430 and mandrel 435 may be coupled via one or more treaded fasteners, pins, and/or other means 440, which may slide within a slot 292 extending through a sidewall of the detector housing 290. The mandrel 435 includes a recess 445 within which a retaining ring and/or other means 455 retains a head 450 of the anti-release member 285. A spring and/or other biasing member 460 disposed within the recess 445 urges the head 450 of the anti-release member 285 towards the retaining means 455 and/or otherwise resists upward movement of the anti-release member 285 relative to the mandrel 435.

The detector housing 290 and the mandrel 435 may each comprise one or more passages 520 through which the electrical conductor 205 may pass and then extend through the anti-release member 285 and the shaft 270. Accordingly, the electrical conductor 205 may be in electrical communication with the electrical conductor 220 of the lower tool string portion 150.

The anti-release member 285 may comprise multiple sections of different diameters. For example, the head 450 of the anti-release member 285 may have a diameter sized for receipt within the recess 445 of the mandrel 435 and containment therein via the retaining means 455. For example, a blocking section 465 of the anti-release member 285 has a diameter sized for receipt within the male latch portion 280 (e.g., within the plurality of flexible members 320) such that the anti-release member 285 prevents disengagement of the female and male latch portions 275 and 280, respectively, when the blocking section 465 is positioned within the male latch portion 280. For example, the blocking section 465 of the anti-release member 285 may be sufficiently sized and/or otherwise configured so that, when positioned within the ends of the plurality of flexible members 320, the flexible members 320 are prevented from deflecting radially inward in response to contact between the inner profile 325 of the female latch portion 275 and the outer profile 330 of each of the flexible members 320 of the male latch portion 280.

The detector 420, plunger 430, mandrel 435, and biasing member 460 may also cooperatively operate to axially translate the anti-release member 285 between its first and second positions described above. For example, in the example implementation and operational stage depicted in FIG. 2, the blocking section 465 of the anti-release member 285 is positioned in the first position, including within the flexible members 320 of the male latch portion 280, such that the blocking section 465 of the anti-release member 285 prevents the radially inward deflection of the flexible members 320, and thus prevents the disengagement of the female and male latch portions 275 and 280, respectively, until the tensile force applied across the DAIA 200 sufficiently overcomes the biasing force(s) of the upper and/or lower spring stacks 350 and 355, respectively. That is, to disengage the female and male latch portions 275 and 280, respectively, the tensile force applied across the DAIA 200 is increased by an amount sufficient to cause relative translation between the blocking section 465 of the anti-release member 285 and the male latch portion 280 by at least a distance 470 sufficient to remove the blocking section 465 of the anti-release member 285 from the ends of the flexible members 320 of the male latch portion 280, thereby permitting the radially inward deflection of the ends of the flexible members 320 and, thus, their disengagement from the female latch portion 275.

In the example implementation depicted in FIG. 2, the distance 470 is about 0.5 inches (or about 1.3 centimeters). However, the distance 470 may range between about 0.2 inches (or about 0.8 centimeters) and about 2.0 inches (or about 5.1 centimeters) within the scope of the present disclosure, and may also fall outside such range yet such implementation would nonetheless remain within the scope of the present disclosure.

Moreover, in the example implementation and operational stage depicted in FIG. 12, the detector 420, plunger 430, mandrel 435, and/or biasing member 460 have cooperatively translated the anti-release member 285 to its second position, such as in response to the detector 420 detecting a current, voltage, and/or other electrical characteristic of the electrical conductor 205. Consequently, the blocking section 465 of the anti-release member 285 is positioned further inside the male latch portion 280 relative to the operational stage depicted in FIG. 2. Accordingly, a greater distance 475, relative to the distance 470 shown in FIG. 2, is traversed by relative axial translation between the blocking section 465 and the ends of the flexible members 320 of the male latch portion 280 before the blocking section 465 is removed from the male latch portion 280 and the female and male latch portions 275 and 280, respectively, may disengage.

In the example implementation depicted in FIG. 12, the distance 475 is about 0.8 inches (or about 2.0 centimeters). However, the distance 475 may range between about 0.3 inches (or about 0.8 centimeters) and about 4.0 inches (or about 10.1 centimeters) within the scope of the present disclosure, and may also fall outside such range yet such implementation would nonetheless remain within the scope of the present disclosure.

As described above, the detector 420, plunger 430, mandrel 435, and/or biasing member 460 may be collectively operable to move the blocking section 465 of the anti-release member 285 from the first position shown in FIG. 2 to (or at least towards) the second position shown in FIG. 12. However, the detector 420, plunger 430, mandrel 435, and/or biasing member 460 may also be collectively operable to return the blocking section 465 of the anti-release member 285 from the second position shown in FIG. 12 to (or at least towards) the first position shown in FIG. 2. To facilitate such movement, the anti-release member 285 may also comprise an aligning section 480 having a diameter at least small enough to permit sufficient radially inward deflection of the ends of the flexible members 320 so as to consequently permit disengagement of the female and male latch portions 275 and 280, respectively. The length of the aligning section 480 may vary within the scope of the present disclosure, but may generally be long enough that the end 485 of the anti-release member 285 remains within the male latch portion 280 and/or the shaft 270 during operation of the DAIA 200.

Moreover, the detector 420, plunger 430, mandrel 435, and/or biasing member 460 may also be collectively operable to move the blocking section 465 of the anti-release member 285 to a third position between the first position shown in FIG. 2 and the second position shown in FIG. 12. For example, the detector 420 may be operable to measure a quantitative value of the electrical characteristic of the electrical conductor 205, instead of (or in addition to) merely detecting the presence or absence of the electrical characteristic. Consequently, the extent to which the detector 420, plunger 430, mandrel 435, and/or biasing member 460 collectively operate to move the blocking section 465 may be based on the measured quantitative value of the electrical characteristic of the electrical conductor 205. For example, the detector 420, plunger 430, mandrel 435, and/or biasing member 460 may collectively operate to position the blocking section 465 of the anti-release member 285 in: (1) the first position shown in FIG. 2 when the electrical characteristic of the electrical conductor 205 measured by the detector 420 is greater than a first predetermined level (e.g., a first predetermined current and/or voltage), (2) the second position shown in FIG. 12 when the electrical characteristic of the electrical conductor 205 measured by the detector 420 is zero or less than a second predetermined level (e.g., a second predetermined current and/or voltage), and (3) a third position between the first and second positions. The third position may be a single predetermined position between to the first and second positions, or may one of multiple predetermined positions each corresponding to a quantitative interval between the first and second predetermined levels.

The detector 420, plunger 430, mandrel 435, and/or biasing member 460 may also or instead collectively operate to position the blocking section 465 of the anti-release member 285 at a third position offset between the first and second positions by an amount proportional to the difference between the measured electrical characteristic and the first and second predetermined levels. For example, if the first predetermined level is ten (10) units (e.g., volts or amperes), the second predetermined level is zero (0) units, the measured electrical characteristic is three (3) units, and the distance between the first and second positions is about ten (10) centimeters, then the third position may be about three (3) centimeters from the from the second position, which is also about seven (7) centimeters from the first position.

Ones of FIGS. 2-21 also depict a floating piston 605 disposed within the annulus 610 defined between the outer profile of the shaft 270 and the inner profile of the lower housing 260. The floating piston 605 may fluidly isolate a lower portion of annulus 610 below the floating piston 605 from an upper portion of the annulus 610. At least a portion of the annulus 610 may thus be utilized for pressure compensation of wellbore fluid and/or hydraulic oil contained within the DAIA 200.

Figure 23:
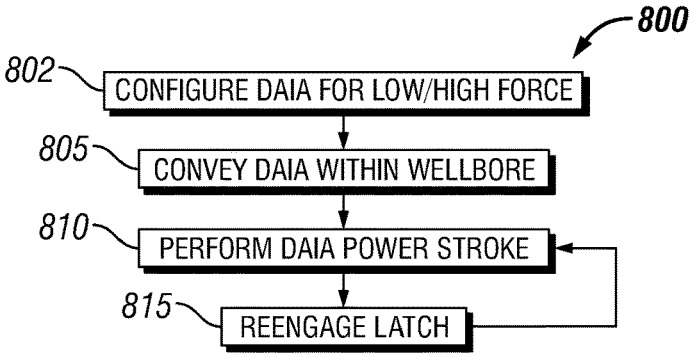
FIG. 23 is a flow-chart diagram of at least a portion of a method according to one or more aspects of the present disclosure.

FIG. 23 is a flow-chart diagram of at least a portion of a method 800 of operations utilizing the DAIA 200 according to one or more aspects of the present disclosure, such as in the example operating environment depicted in FIG. 1, among others within the scope of the present disclosure. Referring to FIGS. 1-3, 12, 13, and 23, collectively, the method 800 may comprise conveying 805 the tool string 810 with the DAIA 200 within a wellbore 120 extending into a subterranean formation 130. Alternatively, the DAIA 200 may be conveyed within the wellbore 120 to the tool string 110.

During such conveyance 805, the DAIA 200 may be in the configuration shown in FIGS. 2 and 3, in which the detector 420 is detecting an electrical characteristic (e.g., current and/or voltage) from the electrical conductor 205, such as may be received via electronic communication with surface equipment 175 via the electrical conductor 210 of the upper tool string portion 140 and (perhaps) the conveyance means 160. However, the DAIA 200 may also be in the configuration shown in FIGS. 12 and 13, in which the detector 420 is not detecting the electrical characteristic (or is detecting the absence of the electrical characteristic) from the electrical conductor 205. The method 800 may comprise actively configuring 802 the DAIA 200 in a predetermined one of the configurations shown in FIGS. 2/3 and 12/13, such as by operating the surface equipment 175 to establish the electrical characteristic detectable by the detector 420, whether such configuring 802 occurs before or after conveying 805 the DAIA 200 within the wellbore 120.

Figure 4:
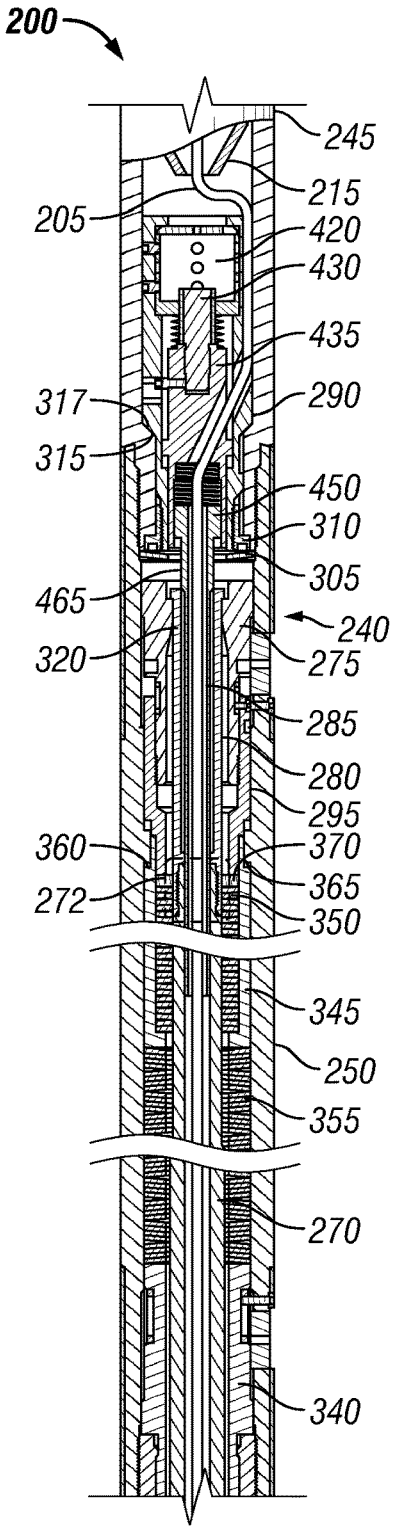
FIGS. 4 and 5 are sectional views of the example implementation shown in FIGS. 2 and 3, respectively, in a subsequent stage of operation according to one or more aspects of the present disclosure.
Figure 14:
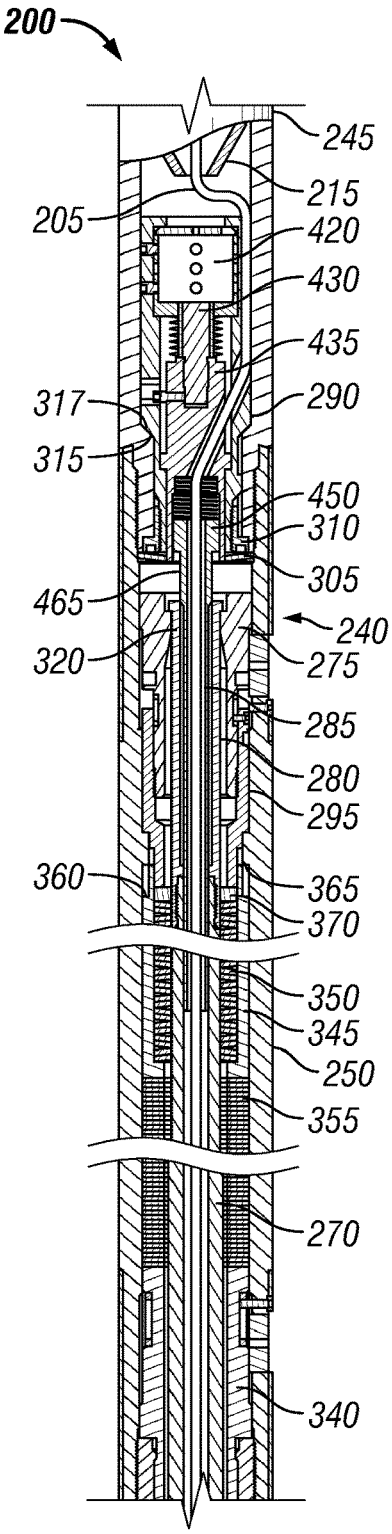
FIGS. 14 and 15 are sectional views of the example implementation shown in FIGS. 12 and 13, respectively, in a subsequent stage of operation according to one or more aspects of the present disclosure.

During subsequent operations, the lower tool string portion 150 may be lodged or stuck in the wellbore 120. Consequently, the method 800 comprises performing 810 a power stroke of the DAIA 200, such as is depicted in FIGS. 4/5 when the detector 420 detects the electrical characteristic or in FIGS. 14/15 when the detector 420 fails to detect the electrical characteristic. During the power stroke, the tensioning device 170 of the surface equipment 175 is increasing the tension applied across the tool string 110 by pulling on the conveyance means 160. As the tension increases, the engagement between the female and male latch portions 275 and 280, respectively, operates to overcome the biasing force of the upper and/or lower spring stacks 350 and 355, respectively, thus causing the upper DAIA section 230 to translate axially away from the lower DAIA section 235. The tension is increased in this manner by an amount sufficient for the blocking section 465 of the anti-release member 285 to emerge from within the ends of the flexible members 320 of the male latch portion 280, as shown in FIGS. 4 and 14.

Figure 6:
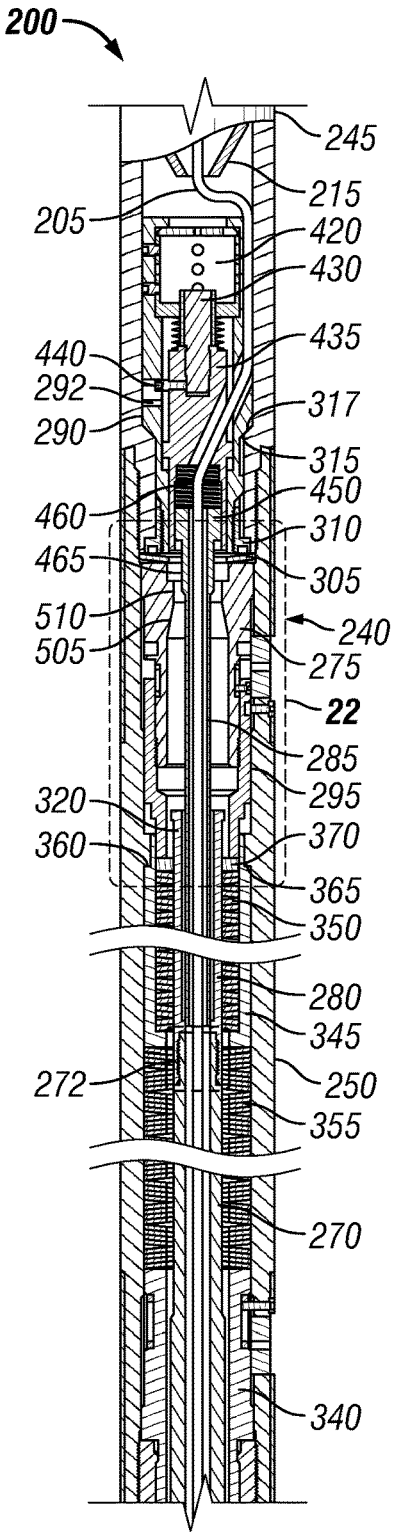
FIGS. 6 and 7 are sectional views of the example implementation shown in FIGS. 4 and 5, respectively, in a subsequent stage of operation according to one or more aspects of the present disclosure.
Figure 7:
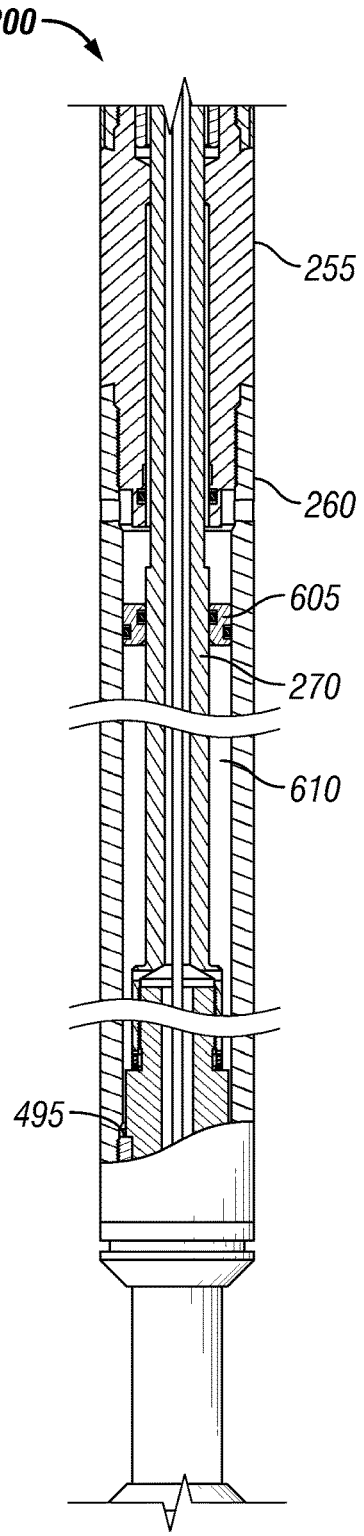
Figure 16:
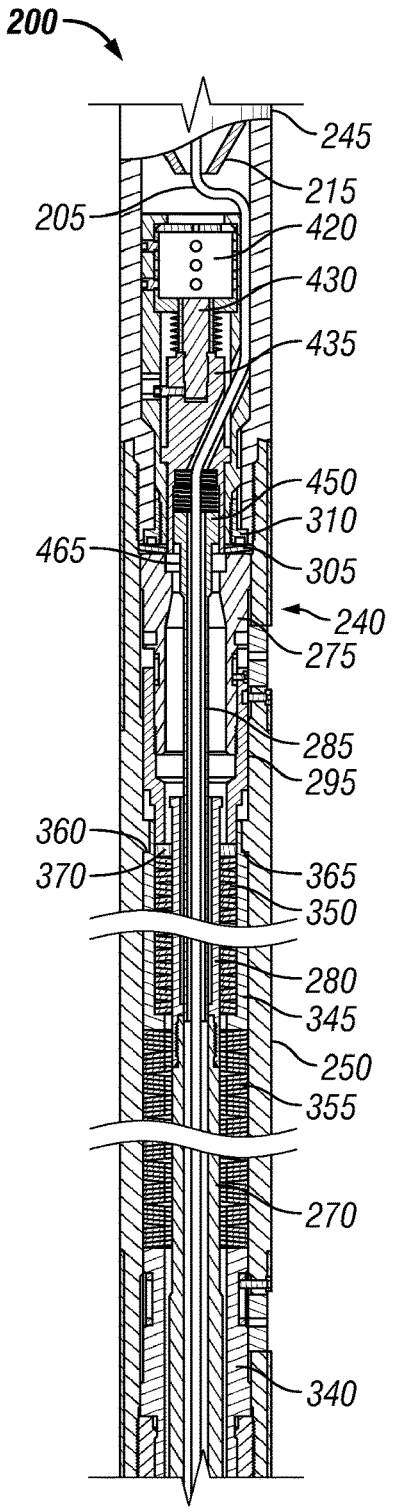
FIGS. 16 and 17 are sectional views of the example implementation shown in FIGS. 14 and 15, respectively, in a subsequent stage of operation according to one or more aspects of the present disclosure.
Figure 17:
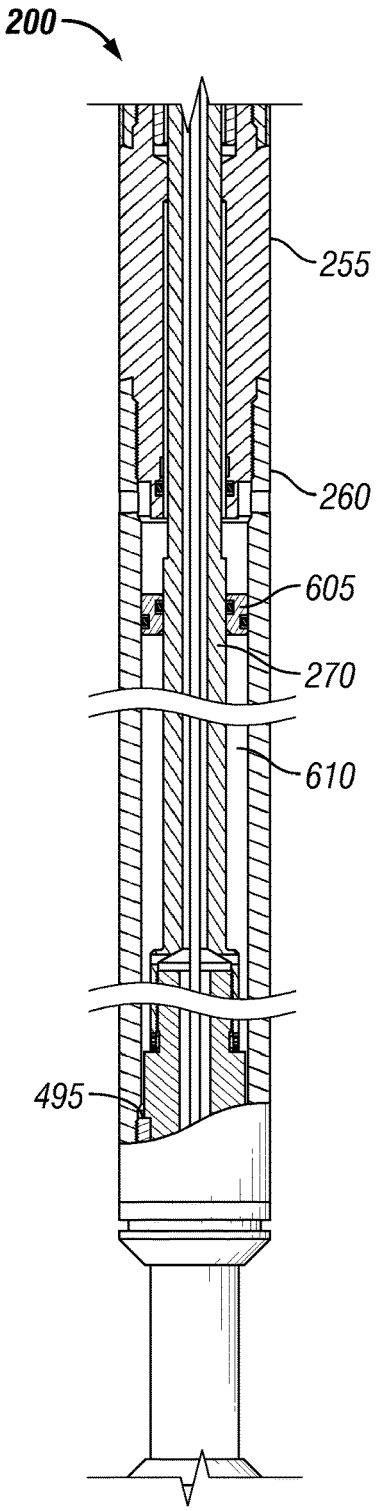

Consequently, the upper ends of the flexible members 320 of the male latch portion 280 are able to deflect radially inward, thus permitting the disengagement of the female and male latch portions 275 and 280, respectively, such that the upper DAIA section 230 rapidly translates away from the lower DAIA section 235 until one or more shoulders, bosses, flanges, and/or other impact features 490 of the upper DAIA section 230 collide with a corresponding one or more shoulders, bosses, flanges, and/or other impact features 495 of the lower DAIA section 235. Such impact may be as depicted in FIGS. 6 and 7 when the detector 240 is detecting the electrical characteristic via the electrical conductor 205, or as depicted in FIGS. 16 and 17 when the detector 240 is not detecting (or is detecting the absence of) the electrical characteristic.

The resulting impact force is imparted to the lower tool string portion 150, such as along a load path extending from the impact features 495 to the lower tool string portion 150 via the lower sub 265 (and perhaps additional components not explicitly shown in the figures). The impact force may be substantially equal to, or perhaps a few percentage points less than, the tensile force being applied by the tensioning device 175 and/or otherwise acting across the DAIA 200 and/or the tool string 110 at or near the instant in time when the female and male latch portions 275 and 270, respectively, became disengaged.

Figure 8:
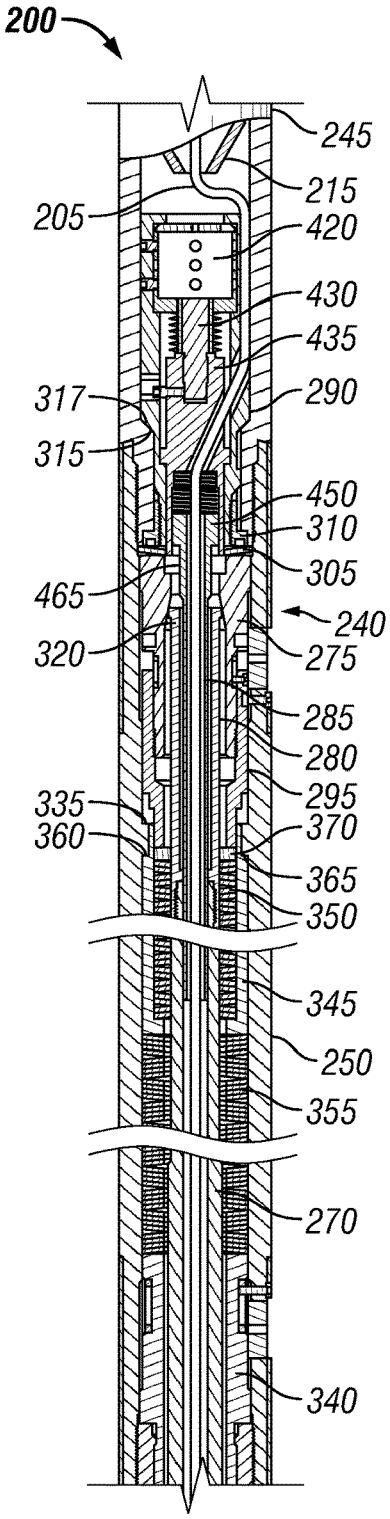
FIGS. 8 and 9 are sectional views of the example implementation shown in FIGS. 6 and 7, respectively, in a subsequent stage of operation according to one or more aspects of the present disclosure.
Figure 9:
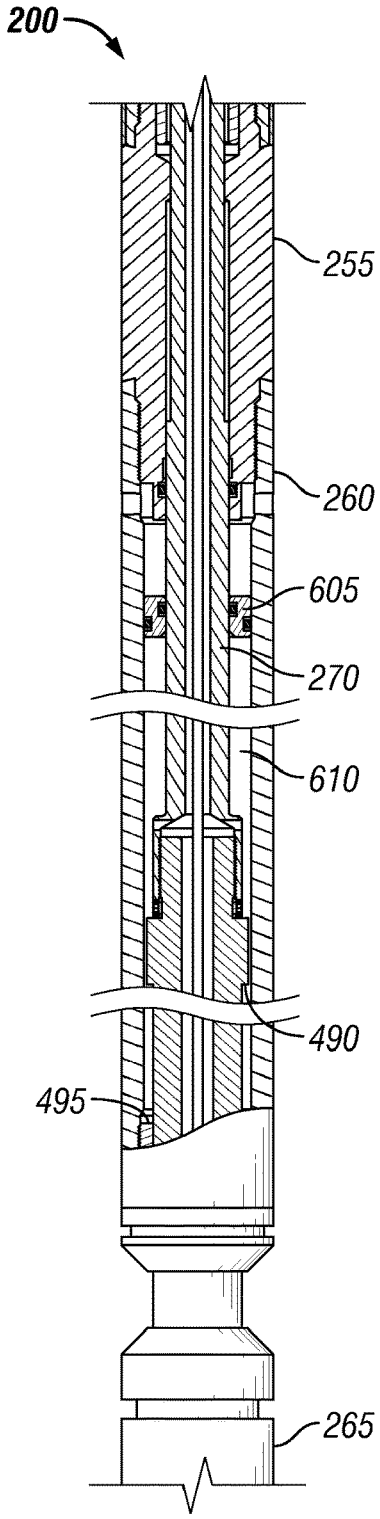
Figure 18:
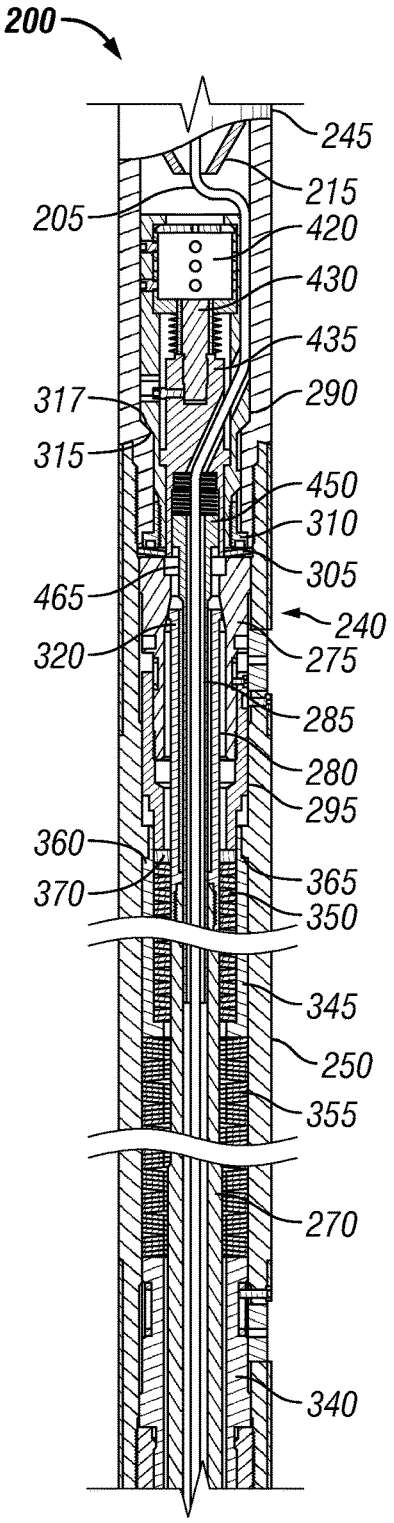
FIGS. 18 and 19 are sectional views of the example implementation shown in FIGS. 16 and 17, respectively, in a subsequent stage of operation according to one or more aspects of the present disclosure.
Figure 19:
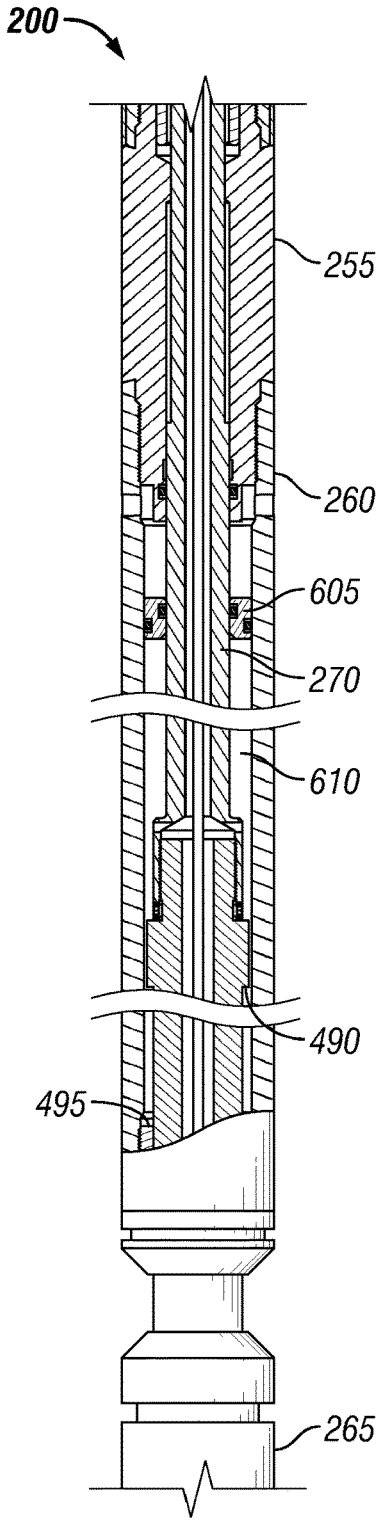

The method 800 may subsequently comprise reengaging 815 the female and male latch portions 275 and 280, respectively. For example, the tensioning device 175 may be operated to reduce the tension being applied to the tool string 110 such that, as depicted in FIGS. 8 and 9 if the detector 240 detects the electrical characteristic, and as depicted in FIGS. 18 and 19 if the detector 240 doesn't detect (or detects the absence of) the electrical characteristic, the upper DAIA section 230 will once again settle downward towards the lower DAIA section 235 (e.g., due to gravitational forces). Such relative axial translation of the upper and lower DAIA sections 230 and 235, respectively, will cause the outer edges of the upper ends of the flexible members 320 to contact one or more conical and/or otherwise tapered internal surfaces 505 of the female latch portion 275, such that continued relative axial translation of the upper and lower DAIA sections 230 and 235, respectively, will cause the upper ends of the flexible members 320 to slide along the tapered surfaces 505, thus causing the ends of the flexible members 320 to again deflect radially inward and subsequently travel through an inner diameter portion 510 of the inner profile 325 of the female latch portion 275.

Figure 10:
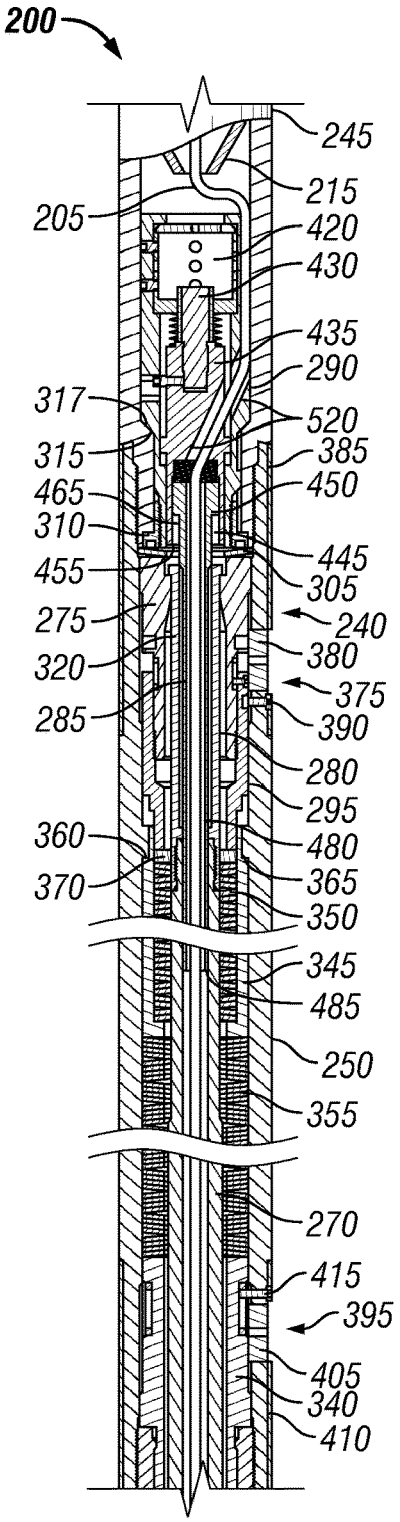
FIGS. 10 and 11 are sectional views of the example implementation shown in FIGS. 8 and 9, respectively, in a subsequent stage of operation according to one or more aspects of the present disclosure.
Figure 11:
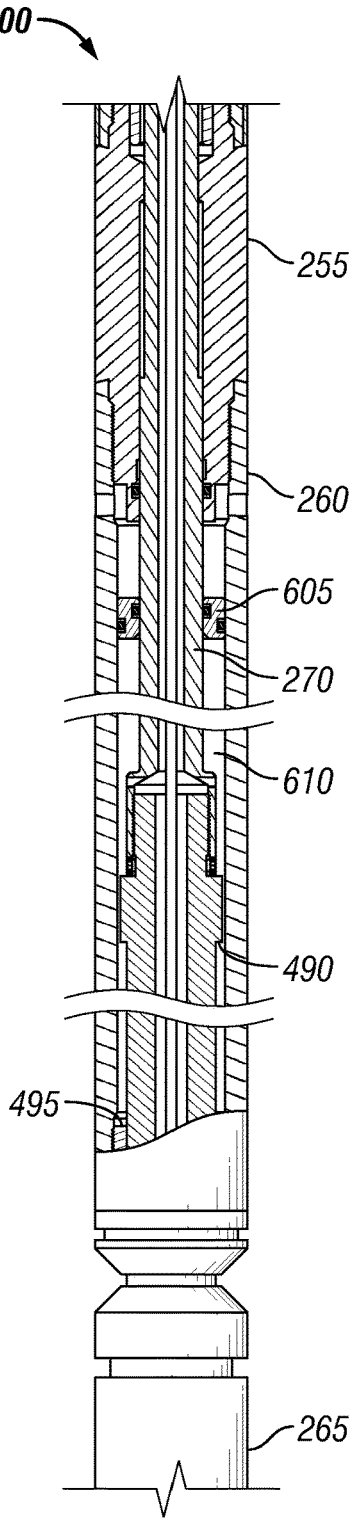
Figure 20:
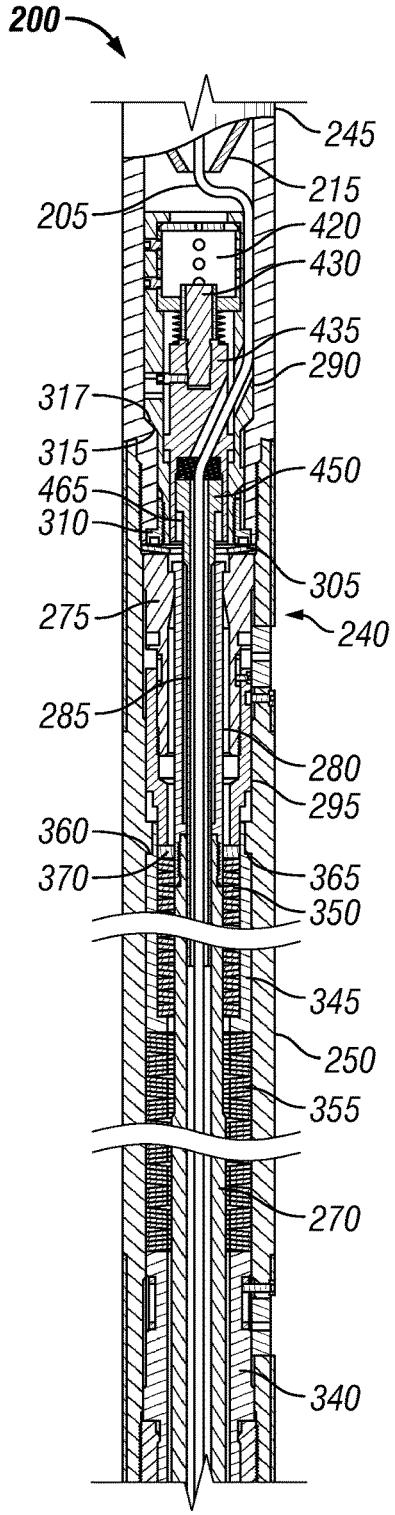
FIGS. 20 and 21 are sectional views of the example implementation shown in FIGS. 18 and 19, respectively, in a subsequent stage of operation according to one or more aspects of the present disclosure.
Figure 21:
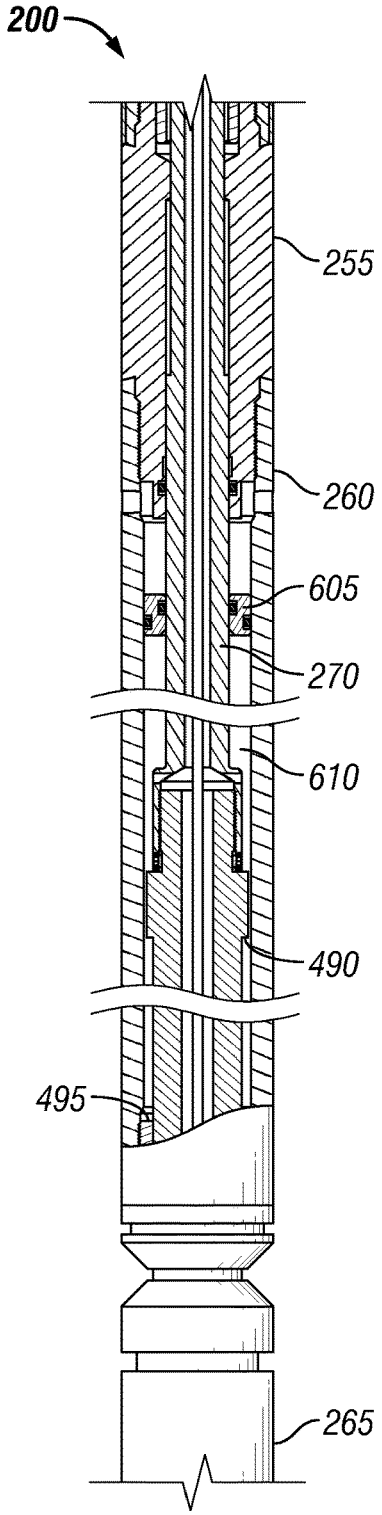

Continued relative axial translation of the upper and lower DAIA sections 230 and 235, respectively, as depicted in FIGS. 10 and 11 if the detector 240 detects the electrical characteristic, and as depicted in FIGS. 20 and 21 if the detector 240 doesn't detect (or detects the absence of) the electrical characteristic, will cause the inwardly deflected ends of the flexible members 320 to contact the lower end of the blocking section 465 of the anti-release member 285. Such contact may then urge the head 450 of the anti-release member 285 to translate axially upwards into the recess 445 of the mandrel 435, such as by overcoming the biasing force of the biasing member 460. Accordingly, the ends of the flexible members 320 may travel upwards past the inner diameter portion 510 of the inner profile 325 of the female latch portion 275, whereby the outer profiles 330 of the ends of the flexible members 320 may reengage with the inner profile 325 of the female latch portion 275.

The method 800 may comprise multiple iterations of performing 810 the power stroke and subsequently reengaging 815 the female and male latch portions 275 and 280, respectively, utilizing the DAIA 200 in the "low-force" configuration depicted in FIGS. 2-11, until the impact force iteratively imparted to the lower tool string portion 150 is sufficient to dislodge the lower tool string portion 150. However, the impact force imparted to the lower tool string portion 150 by the DAIA 200 when operating the DAIA 200 in the configuration depicted in FIGS. 2-11, in which the detector 240 is detecting the electrical characteristic, may not be sufficient to dislodge the lower tool string portion 150.

Figure 24:
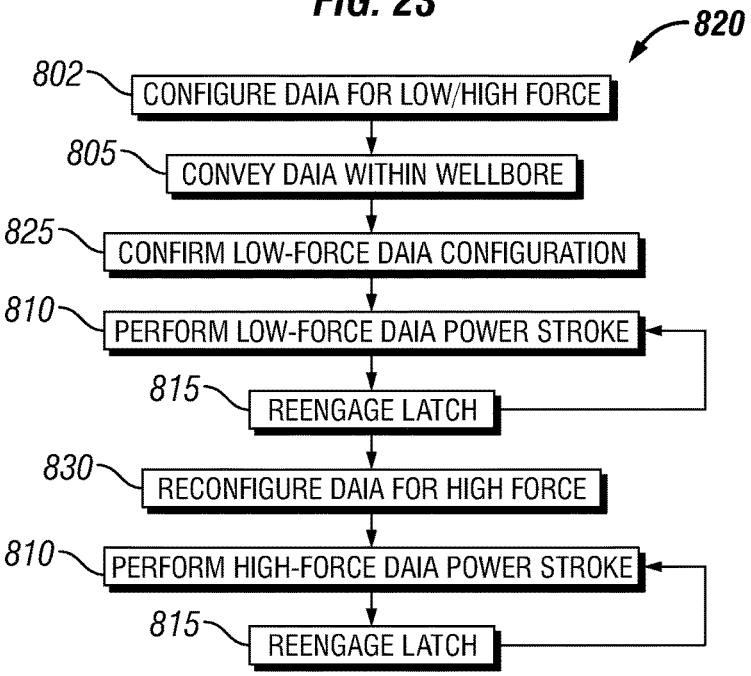
FIG. 24 is a flow-chart diagram of at least a portion of a method according to one or more aspects of the present disclosure.

Consequently, FIG. 24 is a flow-chart diagram of a similar method 820 according to one or more aspects of the present disclosure. The method 820 shown in FIG. 24 may be substantially similar to, or perhaps comprise multiple iterations of, the method 800 shown in FIG. 23, and/or variations thereof.

The method 820 comprises conveying 805 the DAIA 200 within the wellbore 120, whether as part of the tool string 110 before the tool string 110 gets stuck, or after the tool string 110 is already stuck in the wellbore 120. During the conveying 805, the DAIA 200 may be in the configuration shown in FIGS. 2 and 3, in which the detector 420 is detecting the electrical characteristic, or the DAIA 200 may be in the configuration shown in FIGS. 12 and 13, in which the detector 420 is not detecting (or detects the absence of) the electrical characteristic. The method 820 may comprise actively configuring 802 the DAIA 200 in a predetermined one of the configurations shown in FIGS. 2/3 and 12/13, such as by operating the surface equipment 175 to establish the electrical characteristic detectable by the detector 420, whether such configuring 802 occurs before or after conveying 805 the DAIA 200 within the wellbore 120.

Figure 5:
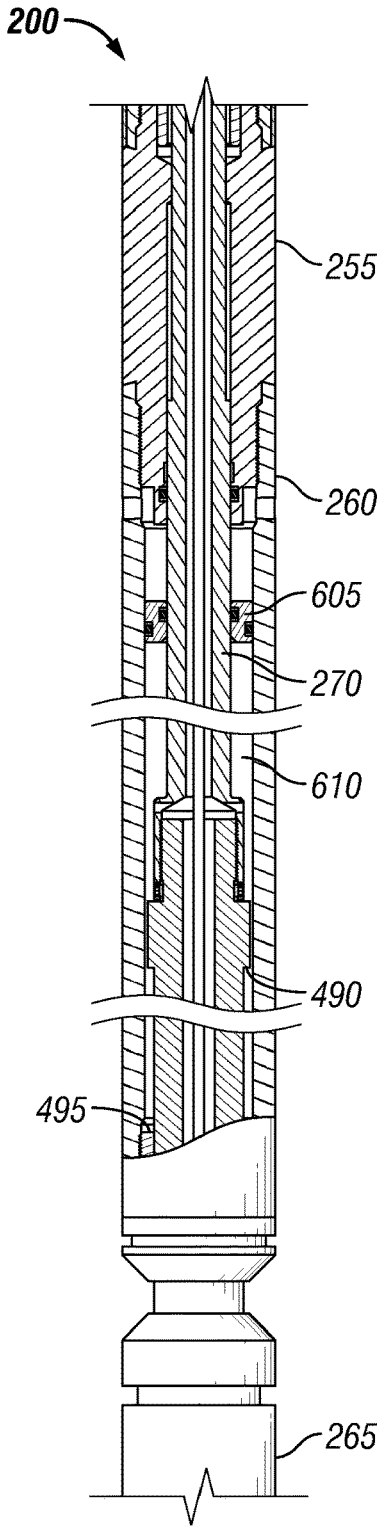

During subsequent operations, the lower tool string portion 150 may be lodged or stuck in the wellbore 120. Consequently, the method 820 may comprise confirming 825 that the DAIA 200 is in the configuration depicted in FIGS. 2 and 3, such as by confirming that the detector 420 is detecting the electrical characteristic, which may comprise operating the surface equipment 170 to establish the electrical characteristic on the electrical conductor 205. The method 820 subsequently comprises one or more iterations of performing 810 the power stroke of the DAIA 200 with the DAIA 200 in the "low-force" configuration, as depicted in FIGS. 4 and 5, until one or more "low-force" impacts are imparted to the lower tool string portion 150, as depicted in FIGS. 6 and 7, and subsequently reengaging 815 the female and male latch portions 275 and 280, respectively, as depicted in FIGS. 8-11.

Figure 13:
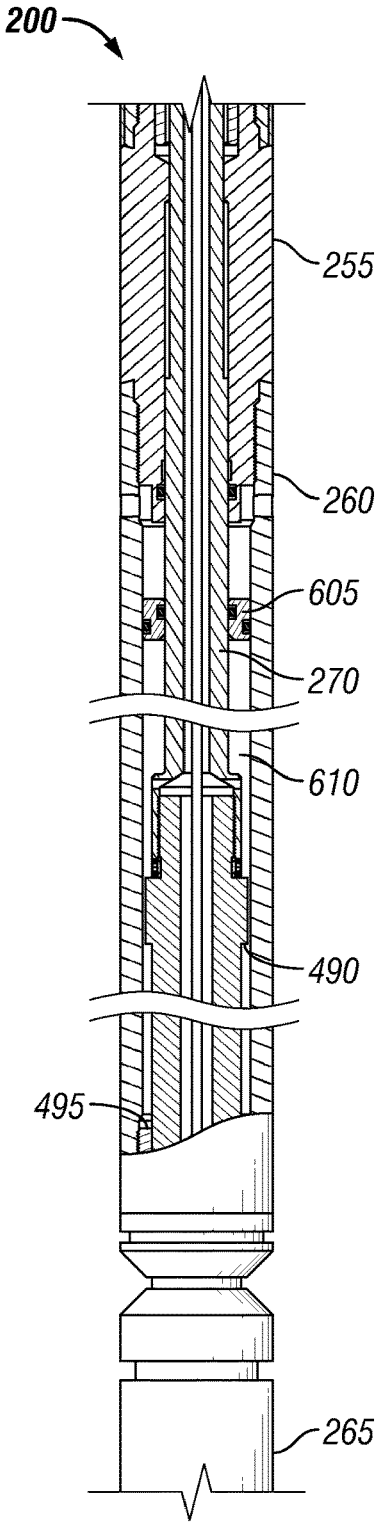
FIG. 13 is a sectional view of another portion of the example implementation shown in FIG. 12 according to one or more aspects of the present disclosure.
Figure 15:
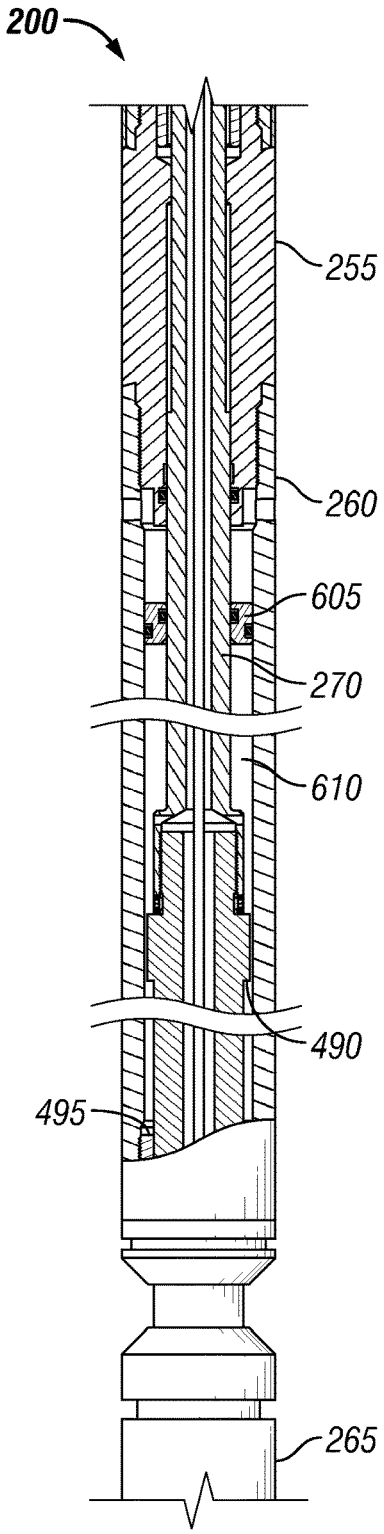

The method 820 subsequently comprises reconfiguring 830 the DAIA 200 to the configuration depicted in FIGS. 12 and 13, such as by confirming that the detector 420 is not detecting (or is detecting the absence of) the electrical characteristic, which may comprise operating the surface equipment 170 to cease application of or otherwise disestablish the electrical characteristic on the electrical conductor 205. The method 820 subsequently comprises one or more iterations of performing 810 the power stroke of the DAIA 200 with the DAIA 200 in the "high-force" configuration, as depicted in FIGS. 14 and 15, until one or more "high-force" impacts are imparted to the lower tool string portion 150, as depicted in FIGS. 16 and 17, and subsequently reengaging 815 the female and male latch portions 275 and 280, respectively, as depicted in FIGS. 18-21.

Operations according to one or more aspects of the present disclosure, including performance of the method 800 shown in FIG. 23 and/or the method 820 shown in FIG. 24, may aid in preventing damage to downhole tools that have been stuck downhole. For example, the electrical characteristic detected by the detector 240 may be, or result from, and electrical power or control signal being sent to the downhole tool(s) of the tool string 110. Accordingly, for example, detection of the electrical characteristic may be indicative of whether one or more downhole tools and/or other portions of the tool string 110 are currently being electrically powered, also referred to as being "on". However, some downhole tools and/or data stored therein may be more susceptible to damage when they are "turned on" while being subjected to impact forces imparted by an impact jar being utilized to dislodge a stuck portion of the tool string 110.

Thus, implementations of the DAIA 200 introduced herein may be utilized to initially attempt dislodging of the tool string 110 with a lower force while one or more downhole tools of the tool string 110 remain powered, or "on", which corresponds to the detector 420, plunger 430, mandrel 435, and/or biasing member 460 being collectively operated to move the blocking section 465 of the anti-release member 285 to (or at least towards) the above-described first position, shown in FIG. 2, that corresponds to the "low-force" being imparted to the stuck tool string 110 because the tension applied by the tensioning device 175 overcomes the upper and/or lower spring stacks 350 and 355, respectively, to a degree sufficient to cause the relative axial translation of the upper and lower DAIA sections 230 and 235, respectively, by the smaller distance 470. If such initial attempts to utilize the "low-force" impacts fails to dislodge the lower tool string portion 150, then the downhole tool(s) and/or tool string 110 may be "turned off" such that the electrical characteristic is not detected by the detector 240, which extends the blocking member 465 further into the male latch portion 280, as shown in FIG. 12, which corresponds to the "high-force" being imparted to the stuck but un-powered tool string 110 because the tension applied by the tensioning device 175 is now overcoming the upper and/or lower spring stacks 350 and 355, respectively, to a greater degree, at least sufficient to cause the relative axial translation of the upper and lower DAIA sections 230 and 235, respectively, by the larger distance 475.

Thus, the present disclosure introduces conveying a tool string within a wellbore extending between a wellsite surface and a subterranean formation, wherein the tool string comprises: a first portion comprising a first electrical conductor in electrical communication with surface equipment disposed at the wellsite surface; a second portion; and a downhole-adjusting impact apparatus (DAIA) interposing the first and second portions and comprising a second electrical conductor in electrical communication with the first electrical conductor, wherein the DAIA is operable to impart, to the second portion of the tool string, a selective one of first and second different impact forces each corresponding to one of detection and non-detection of the electrical characteristic by the DAIA. At least one of the surface equipment and the DAIA is then operated to impart a selective one of the first and second impact forces to the second portion of the tool string.

Operating at least one of the surface equipment and the DAIA to impart a selective one of the first and second impact forces to the second portion of the tool string may comprise: operating the surface equipment to apply the electrical characteristic to the first and second electrical conductors, thereby selecting which one of the first and second impact forces will be imparted by the DAIA to the second portion of the tool string; and operating the surface equipment to impart a tensile load to the first portion of the tool string, and thus to the DAIA, wherein the tensile load is not substantially less than the selected one of the first and second impact forces. Operating the surface equipment to apply the electrical characteristic to the first and second electrical conductors may comprise establishing a voltage and/or current detectable by the DAIA on the second electrical conductor.

Furthermore, operating at least one of the surface equipment and the DAIA to impact a selective one of the first and second impact forces to the second portion of the tool string may comprise operating the at least one of the surface equipment and the DAIA to impart to the second portion of the tool string a smaller one of the first and second impact forces, such as the "low-force" impact described above and corresponding to FIGS. 2-11, and the method may further comprise operating the at least one of the surface equipment and the DAIA to impart to the second portion of the tool string a larger one of the first and second impact forces, such as the "high-force" impact described above and corresponding to FIGS. 12-22. In such methods, operating the surface equipment and/or the DAIA to impart to the second portion of the tool string the smaller one of the first and second impact forces (e.g., the "low-force" impact) may comprise applying the electrical characteristic to the first and second electrical conductors, and subsequently operating the surface equipment and/or the DAIA to impart to the second portion of the tool string the larger one of the first and second impact forces (e.g., the "high-force" impact) may comprise ceasing application of the electrical characteristic to the first and second electrical conductors.

Such methods may further comprise, before conveying the tool string within the wellbore, externally accessing an adjuster internal to the DAIA to rotate the adjuster relative to an external housing of the DAIA and thereby adjust one but not both of the first and second impact forces.

Such methods may further comprise, before conveying the tool string within the wellbore, externally accessing each of first and second adjusters internal to the DAIA to rotate the first and second adjusters relative to other components of the DAIA and thereby adjust the first and second impact forces and/or a quantitative (e.g., magnitude) difference between the first and second impact forces.

Figure 25:
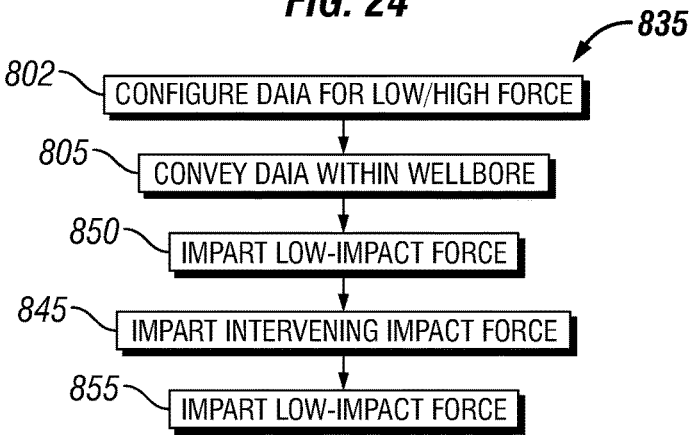
FIG. 25 is a flow-chart diagram of at least a portion of a method according to one or more aspects of the present disclosure.

FIG. 25 is a flow-chart diagram of a similar method 835 according to one or more aspects of the present disclosure. The method 820 shown in FIG. 24 may be substantially similar to, or perhaps comprise multiple iterations of, at least a portion of the method 800 shown in FIG. 23, at least a portion of the method 820 shown in FIG. 24, and/or variations thereof.

Referring to FIGS. 1 and 25, among others, the method 835 comprises conveying 805 the tool string 110 within the wellbore 120, wherein the tool string 110 comprises the first portion 140, the second portion 150, and the DAIA 200 described above. Alternatively, the conveying 840 may comprise conveying the DAIA 200 to the tool string 110 already stuck in the wellbore 120. The method 840 may also comprise actively configuring 802 the DAIA 200 in a predetermined one of the configurations shown in FIGS. 2/3 and 12/13, such as by operating the surface equipment 175 to establish the electrical characteristic detectable by the detector 420, whether such configuring 802 occurs before or after conveying 805 the DAIA 200 within the wellbore 120.

As above, the DAIA 200 is operable to impart, to the second portion 150 of the tool string 110, a selective one of: a first impact force when the electrical characteristic is detected by the detector 240 of the DAIA 200 and the tensioning device 175 is applying a first tensile force to the tool string 110; and a second impact force when the electrical characteristic is not detected (or its absence is detected) by the detector 240 and the surface equipment is applying a second tensile force to the tool string 110. As described above, the first impact force (e.g., the above-described "low-force") may be substantially less in magnitude than the second impact force (e.g., the above-described "high-force"), and the first tensile force may similarly be substantially less than the second tensile force.

The method 840 further comprises operating at least one of the surface equipment 170 and the DAIA 200 to impart 845 an intervening impact force to the second portion 150 of the tool string 110 by: confirming that the electrical characteristic is not existent on (and/or at least not being applied to and/or detected on) electrical conductors of the tool string 110 and/or the DAIA 200; then applying an intervening tensile force to the tool string 110, wherein the intervening tensile force is substantially greater than the first tensile force and substantially less than the second tensile force; and then applying the electrical characteristic to the electrical conductors of the tool string 110 and/or the DAIA 200, wherein the intervening impact force is substantially greater than the first impact force and substantially less than the second impact force. When performing the method 840, the first impact force and the first tensile force may be substantially similar in magnitude, the second impact force and the second tensile force may be substantially similar in magnitude, and the intervening impact force and the intervening tensile force may be substantially similar in magnitude.

The method 840 may further comprise, before operating the surface equipment 170 and/or the DAIA 200 to impart 845 the intervening impact force to the second portion 150 of the tool string 110, operating the surface equipment 170 and/or the DAIA 200 to impart 850 the first impact force to the second portion 150 of the tool string 110 by: applying the electrical characteristic to the electrical conductors of the tool string 110 and/or the DAIA 200; and then applying the first tensile force to the tool string 110.

The method 840 may further comprise, after operating the surface equipment 170 and/or the DAIA 200 to impart 845 the intervening impact force to the second portion 150 of the tool string 110, operating the surface equipment 170 and/or the DAIA 200 to impart 855 the second impact force to the second portion 150 of the tool string 110 by: confirming that the electrical characteristic is not being applied to the electrical conductors of the tool string 110 and/or the DAIA 200; and then applying the second tensile force to the tool string 110.

In view of all of the entirety of the present disclosure, including FIGS. 1-25, a person having ordinary skill in the art will readily recognize that, in addition to the methods 800, 820, and 835 described above, the present disclosure introduces an apparatus comprising: a downhole-adjusting impact apparatus (DAIA) mechanically coupled between opposing first and second portions of a tool string, wherein: the tool string is conveyable within a wellbore extending between a wellsite surface and a subterranean formation; the first tool string portion comprises a first electrical conductor in electrical communication with surface equipment disposed at the wellsite surface; the DAIA comprises a second electrical conductor in electrical communication with the first electrical conductor; and the DAIA is operable to: detect an electrical characteristic of the second electrical conductor; impart a first impact force on the second tool string portion when the electrical characteristic is detected; and impart a second impact force on the second tool string portion when the electrical characteristic is not detected, wherein the second impact force is substantially greater than the first impact force.

The first impact force may range between about 1,000 pounds (or about 4.4 kilonewtons) and about 6,000 pounds (or about 26.7 kilonewtons). The second impact force may range between about 6,000 pounds (or about 26.7 kilonewtons) and about 12,000 pounds (or about 53.4 kilonewtons). A difference between the first and second impact forces may range between about 1,000 pounds (or about 4.4 kilonewtons) and about 6,000 pounds (or about 26.7 kilonewtons).

The electrical characteristic is a substantially non-zero voltage. The electrical characteristic may be a voltage substantially greater than about 0.1 volts. The electrical characteristic may be a substantially non-zero current. The electrical characteristic may be a current substantially greater than about 0.01 amperes.

The apparatus may further comprise means for conveyance of the tool string within the wellbore. The conveyance means may comprise wireline or slickline extending between the first tool string portion and surface equipment disposed at the wellsite surface.

The second tool string portion may comprise a third electrical conductor in electrical communication with the first electrical conductor via at least the second electrical conductor.

The DAIA may further comprise: a first DAIA section coupled to the first tool string portion; a second DAIA section coupled to the second tool string portion; and a latching mechanism comprising: a female latch portion; a male latch portion comprising a plurality of flexible members collectively operable to detachably engage the female latch portion, wherein the female and male latch portions are carried by corresponding ones of the first and second DAIA sections; and an anti-release member moveable within the female and male latch portions between a first position, when the DAIA detects the electrical characteristic, and a second position, when the DAIA does not detect the electrical characteristic. The detachable engagement between the female and male latch portions may be between an internal profile of the female latch portion and an external profile of each of the plurality of flexible members. The anti-release member may prevent disengagement of the female and male latch portions when a tensile force applied across the latching mechanism is substantially less than: the first impact force, when the anti-release member is in the first position; and the second impact force, when the anti-release member is in the second position.

The DAIA may further comprise a spring stack operable to resist relative axial movement, and thus disengagement, of the female and male latch portions. A magnitude of the second impact force may be adjustable in response to adjustment of an axial position of a static end of the spring stack relative to the first DAIA section. The axial position of the static end of the spring stack may be adjustable via external access through a sidewall window of the first DAIA section. The female latch portion may be carried with the first DAIA section, the male latch portion may be carried with the second DAIA section, the first DAIA section may comprise an adjuster disposed within the first DAIA section at an axial position that may be adjustable relative to the first DAIA section in response to rotation of the adjuster relative to the first DAIA section, a magnitude of the second impact force may be adjustable in response to adjustment of an axial position of a static end of the spring stack relative to the first DAIA section, and the adjustment of the axial position of the static end of the spring stack relative to the first DAIA section may be via adjustment of the axial position of the adjuster in response to rotation of the adjuster relative to the first DAIA section.

A difference between a first magnitude of the first impact force and a second magnitude of the second impact force may be adjustable in response to adjustment of an axial position of a static end of the spring stack relative to the female latch portion. The axial position of the static end of the spring stack may be adjustable relative to the female latch portion via external access through a sidewall window of the first DAIA section.

The female latch portion may be carried with the first DAIA section, the male latch portion may be carried with the second DAIA section, the first DAIA section may comprise an adjuster disposed within the first DAIA section, relative axial positions of the female latch portion and the adjuster may be adjustable in response to relative rotation between the female latch portion and the adjuster, a difference between a first magnitude of the first impact force and a second magnitude of the second impact force may be adjustable in response to adjustment of an axial position of a static end of the spring stack relative to the female latch portion, and the adjustment of the axial position of the static end of the spring stack relative to the female latch portion may be via adjustment of the relative axial positions of the female latch portion and the adjuster in response to relative rotation between the female latch portion and the adjuster.

The DAIA may further comprises: a first spring stack operable to resist relative axial movement, and thus disengagement, of the female and male latch portions, wherein a difference between a first magnitude of the first impact force and a second magnitude of the second impact force may be adjustable in response to adjustment of a first axial position of a first static end of the first spring stack relative to the female latch member; and a second spring stack operable to resist relative axial movement, and thus disengagement, of the female and male latch portions, wherein the second magnitude of the second impact force may be adjustable in response to adjustment of a second axial position of a second static end of the second spring stack relative to the first DAIA section. Adjustment of the first axial position of the first static end of the first spring stack relative to the female latch member may be via external access through a first sidewall window of the first DAIA section, and adjustment of the second axial position of the second static end of the second spring stack relative to the first DAIA section may be via external access through a second sidewall window of the first DAIA section.

The first DAIA section may comprise: a first sub coupled to the first tool string portion; a first housing coupled to the first sub; a connector coupled to the first housing opposite the first sub; and a second housing coupled to the connector opposite the first housing. The second DAIA section may comprise: a second sub coupled to the second tool string portion; and a shaft extending between the second sub and the latching mechanism. The shaft may extend into the second housing, the connector, and the first housing. The male latch portion may be carried with the shaft.

The DAIA may further comprise a detector operable to detect the electrical characteristic. The detector may be operable to detect a presence of current or voltage of the second electrical conductor. The detector may be operable to measure a quantitative value of the electrical characteristic. The detector may comprise a sensor selected from the group consisting of: a transformer; a Hall effect sensor; a Faraday sensor; and a magnetometer. The DAIA may further comprise: a first DAIA section coupled to the first tool string portion; a second DAIA section coupled to the second tool string portion; a latching mechanism comprising: a female latch portion; a male latch portion comprising a plurality of flexible members collectively operable to detachably engage the female latch portion, wherein the female and male latch portions may be carried by corresponding ones of the first and second DAIA sections; and an anti-release member moveable within the female and male latch portions between a first position, when the DAIA detects the electrical characteristic, and a second position, when the DAIA does not detect the electrical characteristic; and an actuator operable to move the anti-release member between the first and second positions based on whether the detector detects the electrical characteristic. The actuator may comprise a solenoid.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. A method comprising:

conveying a tool string within a wellbore via conveyance means, wherein the tool string comprises an impact apparatus previously adjusted for imparting first and second impact forces to the tool string;

then causing the impact apparatus to impart the first impact force to the tool string by applying a first tension to the tool string via the conveyance means while a voltage or current detectable by the impact apparatus is established via conductors within the conveyance means and the tool string; and then causing the impact apparatus to impart the second impact force to the tool string by applying a second tension to the tool string via the conveyance means while the voltage or current is removed from the conductors, wherein the second impact force and the second tension are respectively greater than the first impact force and the first tension, and wherein a component of the tool string other than the impact apparatus comprises an electrical apparatus powered by the voltage or current, such that:

the first impact force is imparted to the tool string while the electrical apparatus is electrically powered by the voltage or current; and the second impact force is imparted to the tool string while the electrical apparatus is not electrically powered by the voltage or current.

2. The method of claim 1 wherein the first tension is a minimum tension at which the impact apparatus is able to generate any impact force while the voltage or current is detected by the impact apparatus, and the second tension is a minimum tension at which the impact apparatus is able to generate any impact force while the voltage or current is not detected by the impact apparatus, such that:

the impact apparatus cannot generate the first impact force when the voltage or current is not detected by the impact apparatus; and the impact apparatus cannot generate the second impact force when the voltage or current is detected by the impact apparatus.

3. The method of claim 2 wherein the previous adjustment to the impact apparatus sets the first and second tensions at or near predetermined values so that magnitudes of the first and second impact forces are within respective first and second predetermined ranges.

4. The method of claim 3 further comprising performing the adjustment prior to the tool string being conveyed within the wellbore.

5. The method of claim 1 wherein a component of the tool string other than the impact apparatus comprises an electrical apparatus powered by the voltage or current.

6. A method comprising:

conveying a tool string within a wellbore via conveyance means, wherein the tool string comprises an impact apparatus previously adjusted for imparting to the tool string first and second impact forces corresponding to first and second tensions to be applied to the tool string via the conveyance means;

then causing the impact apparatus to impart the first impact force to the tool string by applying the first tension while a voltage or current detectable by the impact apparatus is established via conductors within the conveyance means and the tool string; and then causing the impact apparatus to impart a third impact force to the tool string by applying a third tension while the voltage or current is removed from the conductors and, while maintaining the third tension, reestablishing the voltage or current detectable by the impact apparatus via the conductors;

wherein the third impact force and the third tension are respectively greater than the first impact force and the first tension, wherein the second impact force and the second tension are respectively greater than the third impact force and the third tension, and wherein a component of the tool string other than the impact apparatus comprises an electrical apparatus powered by the voltage or current, such that:

the first impact force is imparted to the tool string while the electrical apparatus is electrically powered by the voltage or current; and the second impact force is imparted to the tool string while the electrical apparatus is not electrically powered by the voltage or current.

7. The method of claim 6 further comprising, after causing the impact apparatus to impact the third impact force, causing the impact apparatus to impart the second impact force to the tool string by applying the second tension while the voltage or current is removed from the conductors.

8. The method of claim 6 wherein the first tension is a minimum tension at which the impact apparatus is able to generate any impact force while the voltage or current is detected by the impact apparatus, and the second tension is a minimum tension at which the impact apparatus is able to generate any impact force while the voltage or current is not detected by the impact apparatus, such that:

the impact apparatus cannot generate the first impact force when the voltage or current is not detected by the impact apparatus; and the impact apparatus cannot generate the second impact force when the voltage or current is detected by the impact apparatus.

9. The method of claim 8 wherein the previous adjustment to the impact apparatus sets the first and second tensions at or near predetermined values so that magnitudes of the first and second impact forces are within respective first and second predetermined ranges.

10. The method of claim 9 further comprising performing the adjustment prior to the tool string being conveyed within the wellbore.

11. The method of claim 6 wherein a component of the tool string other than the impact apparatus comprises an electrical apparatus powered by the voltage or current.

12. The method of claim 6 wherein the first impact force ranges between about 1,000 pounds and about 6,000 pounds, and the second impact force ranges between about 6,000 pounds and about 12,000 pounds.

13. The method of claim 6 wherein the impact apparatus further comprises:

a first section coupled to a first portion of the tool string;

a second section coupled to a second portion of the tool string; and a latching mechanism comprising:

a female latch portion;

a male latch portion comprising a plurality of flexible members collectively operable to detachably engage the female latch portion, wherein the female and male latch portions are carried by corresponding ones of the first and second sections; and an anti-release member moveable within the female and male latch portions between a first position, when the impact apparatus detects the voltage or current, and a second position, when the impact apparatus does not detect the voltage or current.

14. The method of claim 6 wherein:

the method further comprises, after causing the impact apparatus to impact the third impact force, causing the impact apparatus to impart the second impact force to the tool string by applying the second tension while the voltage or current is removed from the conductors;

the first tension is a minimum tension at which the impact apparatus is able to generate any impact force while the voltage or current is detected by the impact apparatus;

the second tension is a minimum tension at which the impact apparatus is able to generate any impact force while the voltage or current is not detected by the impact apparatus;

the impact apparatus cannot generate the first impact force when the voltage or current is not detected by the impact apparatus;

the impact apparatus cannot generate the second impact force when the voltage or current is detected by the impact apparatus;

the previous adjustment to the impact apparatus sets the first and second tensions at or near predetermined values so that magnitudes of the first and second impact forces are within respective first and second predetermined ranges;

the method further comprises performing the adjustment prior to the tool string being conveyed within the wellbore; and a component of the tool string other than the impact apparatus comprises an electrical apparatus powered by the voltage or current, such that:

the first impact force is imparted to the tool string while the electrical apparatus is electrically powered by the voltage or current; and the second impact force is imparted to the tool string while the electrical apparatus is not electrically powered by the voltage or current.

15. A method comprising:

conveying a tool string via conveyance means within a wellbore extending from a wellsite surface, wherein the tool string comprises:

a downhole tool configured to be electrically powered, via the conveyance means, from surface equipment disposed at the wellsite surface; and an impact apparatus operable to detect whether the downhole tool is electrically powered;

operating the conveyance means and the surface equipment to cause the impact apparatus to impart to the tool string one of a first impact force and a second impact force, wherein:

the first impact force is imparted to the tool string when the impact apparatus detects that the downhole tool is electrically powered;

the second impact force is imparted to the tool string when the impact apparatus detects that the downhole tool is not electrically powered; and the second impact force is greater than the first impact force.

16. The method of claim 15 wherein:

operating the conveyance means and the surface equipment to cause the impact apparatus to impart the first impact force comprises increasing tension, applied to the tool string by the conveyance means, to a first tension at which the impact apparatus is configured to be triggered to generate the first impact force while the impact apparatus detects that the downhole tool is electrically powered; and operating the conveyance means and the surface equipment to cause the impact apparatus to impart the second impact force comprises increasing tension, applied to the tool string by the conveyance means, to a second tension at which the impact apparatus is configured to be triggered to generate the second impact force while the impact apparatus detects that the downhole tool not is electrically powered.

17. The method of claim 16 further comprising, before conveying the impact apparatus within the wellbore, adjusting the impact apparatus to set the first and second tensions so that the first and second impact forces have magnitudes within respective first and second predetermined ranges.

18. The method of claim 15 wherein:

operating the conveyance means and the surface equipment to cause the impact apparatus to impart the first impact force comprises increasing tension, applied to the tool string by the conveyance means, to a first tension at which the impact apparatus is configured to be triggered to generate the first impact force while the impact apparatus detects that the downhole tool is electrically powered;

operating the conveyance means and the surface equipment to cause the impact apparatus to impart the second impact force comprises increasing tension, applied to the tool string by the conveyance means, to a second tension at which the impact apparatus is configured to be triggered to generate the second impact force while the impact apparatus detects that the downhole tool not is electrically powered;

the method further comprises, before conveying the impact apparatus within the wellbore, adjusting the impact apparatus to set the first and second tensions so that the first and second impact forces have magnitudes within respective first and second predetermined ranges.

* * * * *